US008848121B2

(12) United States Patent
Sakai

(10) Patent No.: US 8,848,121 B2
(45) Date of Patent: Sep. 30, 2014

(54) DISPLAY APPARATUS, LIQUID CRYSTAL DISPLAY APPARATUS AND TELEVISION RECEIVER

(75) Inventor: Tamotsu Sakai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 38 days.

(21) Appl. No.: 13/697,796

(22) PCT Filed: May 11, 2011

(86) PCT No.: PCT/JP2011/060886

§ 371 (c)(1),
(2), (4) Date: Nov. 14, 2012

(87) PCT Pub. No.: WO2012/002044

PCT Pub. Date: Jan. 5, 2012

(65) Prior Publication Data

US 2013/0063667 A1 Mar. 14, 2013

(30) Foreign Application Priority Data

Jun. 30, 2010 (JP) ..... 2010-150279

(51) Int. Cl.
*G02F 1/141* (2006.01)
*G02F 1/133* (2006.01)
*G09G 3/36* (2006.01)

(52) U.S. Cl.
CPC ..... *G09G 3/3648* (2013.01); *G09G 2320/0209* (2013.01); *G09G 2300/0426* (2013.01); *G09G 2300/0443* (2013.01); *G09G 2310/0205* (2013.01); *G09G 2320/0233* (2013.01)
USPC ..... 349/37; 349/33

(58) Field of Classification Search
USPC ..... 349/33, 37
See application file for complete search history.

(56) References Cited

U.S. PATENT DOCUMENTS

2007/0252800 A1* 11/2007 Abe ..... 345/88
2008/0068524 A1* 3/2008 Kim ..... 349/38
2008/0136759 A1* 6/2008 Kim ..... 345/87
2009/0189881 A1 7/2009 Ooishi et al.

FOREIGN PATENT DOCUMENTS

JP 10-253987 A 9/1998
JP 2003-228084 A 8/2003

(Continued)

OTHER PUBLICATIONS

Official Communication issued in International Patent Application No. PCT/JP2011/060886, mailed on Jun. 14, 2011.

*Primary Examiner* — Dennis Y Kim
(74) *Attorney, Agent, or Firm* — Keating & Bennett, LLP

(57) ABSTRACT

A display device has two data signal lines provided for each column of pixels (α, β, γ). A data signal line (15*q*) to which a pixel electrode (17*a*) contained in a pixel (101) is connected via a transistor (12*a*) and a data signal line (15Q) to which a pixel electrode (17*b*) contained in a pixel (102) adjacent to the pixel (101) in a column-wise direction is connected via a transistor (12*b*) are different from each other. The pixel electrode (17*a*) contained in the column of pixels (β) forms a capacitance (CaP) with a data signal line (15P) provided for the column of pixels (α) and forms a capacitance (Car) with a data signal line (15*r*) provided for the column of pixels (γ). This enhances the display quality of a display device having a plurality of data signal lines provided for each column of pixels.

8 Claims, 33 Drawing Sheets

(56) References Cited

FOREIGN PATENT DOCUMENTS

| | | | |
|---|---|---|---|
| JP | 2005-250050 | A | 9/2005 |
| JP | 2006-071672 | A | 3/2006 |
| JP | 2007-003967 | A | 1/2007 |
| JP | 2009-020197 | A | 1/2009 |
| JP | 2009-175468 | A | 8/2009 |

* cited by examiner

DISPLAY APPARATUS, LIQUID CRYSTAL DISPLAY APPARATUS AND TELEVISION RECEIVER

TECHNICAL FIELD

The present invention relates to a display device having a plurality of data signal lines provided for each column of pixels.

BACKGROUND ART

In recent years, liquid crystal display apparatuses have been made larger and larger in size and higher and higher in definition. Accordingly, there have been increases in the number of pixels and increases in wiring resistance and the like of data signal lines. This has made it difficult to sufficiently charge each pixel.

It should be noted here that Patent Literature 1 (see FIG. 29) discloses a configuration for simultaneously selecting two consecutive scanning signal lines (namely, a scanning signal line connected to odd-numbered pixels and a scanning signal line connected to even-numbered pixels) by providing each column of pixels with two data signal lines (namely, a left-side data signal line and a right-side data signal line), connecting the left-side data signal line to the pixel electrodes of the odd-numbered pixels contained in the same column of pixels, and connecting the right-side data signal line to the pixel electrodes of the even-number pixels contained in the same column of pixels. This configuration makes it possible to simultaneously write data signal potentials to two pixels adjacent to each other in the column-wise direction, thus making it possible to raise the rate of rewriting on the screen and increase charging time for each pixel.

CITATION LIST

Patent Literature 1

Japanese Patent Application Publication, Tokukaihei, No. 10-253987 A (Publication Date: Aug. 10, 1998)

SUMMARY OF INVENTION

Technical Problem

The inventors of the present application found that such provision of each column of pixels with a plurality of data signal lines generates display unevenness a possible cause of which is a parasitic capacitance between a pixel electrode contained in the column of pixels and a data signal line corresponding to the pixel electrode. The reason for the generation of such display unevenness is explained below with reference to FIGS. 30 through 35.

FIG. 30 shows an example of a display (stripe pattern of black and white lines surrounded by gray) image that is supposed to be displayed. In the following, for convenience of explanation, attention is paid to part of the black and white stripe pattern of FIG. 30 as shown in FIG. 31. In FIG. 31, the letters a to f and A to F each correspond to a single pixel. That is, the pixels a, b, e, f, A, B, E, and F display gray, the pixels c and C display white, and the pixels d and D display black. FIG. 32 is an equivalent circuit diagram showing part of a configuration of a conventional liquid crystal panel. In FIG. 32, the pixels 101 to 106 correspond to the pixels a to f of FIG. 31, respectively, and the pixels 111 to 116 correspond to the pixels A to F of FIG. 31, respectively.

A parasitic capacitance produced in each pixel is explained here. FIG. 33 is an equivalent circuit diagram showing the appearance of parasitic capacitances produced in the pixels 101, 102, 111, and 112. FIG. 33 shows that the pixel 101 has a parasitic capacitance Csd_aq produced between a pixel electrode 17*a* and a data signal line 15*q* and a parasitic capacitance Csd_aQ produced between the pixel electrode 17*a* and a data signal line 15Q, that the pixel 102 has a parasitic capacitance Csd_bq produced between a pixel electrode 17*b* and the data signal line 15*q* and a parasitic capacitance Csd_bQ produced between the pixel electrode 17*b* and the data signal line 15Q, that the pixel 111 has a parasitic capacitance Csd_Ar produced between a pixel electrode 17A and a data signal line 15*r* and a parasitic capacitance Csd_AR produced between the pixel electrode 17A and a data signal line 15R, and that the pixel 112 has a parasitic capacitance Csd_Br produced between a pixel electrode 17B and the data signal line 15*r* and a parasitic capacitance Csd_BR produced between the pixel electrode 17B and the data signal line 15R.

FIG. 34 is a timing chart showing a method (normally black mode) for driving a liquid crystal panel in displaying the image of FIG. 31. FIG. 35 shows a display image that is displayed by the driving method. In FIG. 34, the reference sings Sp, SP, Sq, SQ, Sr, and SR refer to data signals that are supplied to the data signal lines 15*p*, 15P, 15*q*, 15Q, 15*r*, and 15R (see FIG. 32), respectively, the reference signs GPa, GPb, GPc, GPd, GPe, and GPf refer to gate signals (scanning signals) that are supplied to the scanning signal lines 16*a*, 16*b*, 16*c*, 16*d*, 16*e*, and 16*f* (see FIG. 32), respectively, and the reference signs Va, Vb, VA, VB, Vc, Vd, Ve, and Vf refer to potentials (pixel potentials) of the pixels electrodes 17*a*, 17*b*, 17A, 17B, 17*c*, 17*d*, 17*e*, and 17*f* (see FIG. 32), respectively.

According to the present driving method, as shown in FIG. 34, two scanning signals are simultaneously selected at a time and each data signal line is supplied with a data signal whose polarity is reversed every single frame period, and during the same horizontal scanning period, two data signal lines (15*p* and 15P, 15*q* and 15Q, 15*r* and 15R) corresponding to the same column of pixels are supplied with data signals of opposite polarities while two adjacent data signal lines (15P and 15*q*, 15Q and 15*r*, 15R and 15*s*) are supplied with data signals of the same polarity.

Specifically, in F1, of the consecutive frames F1 and F2, the data signal line 15*p*, the data signal line 15Q, and the data signal line 15*r* are each supplied with a data signal of a positive polarity during the kth horizontal scanning period (including the scanning period for the scanning signal lines 16*a* and 16*b*), supplied with a data signal of a positive polarity during the (k+1)th horizontal scanning period (including the scanning period for the scanning signal lines 16*c* and 16*d*), and also supplied with a data signal of a positive polarity during the (k+2)th horizontal scanning period (including the scanning period for the scanning signal lines 16*e* and 16*f*). Meanwhile, the data signal line 15P, the data signal line 15*q*, and the data signal line 15R are each supplied with a data signal of a negative polarity during the kth horizontal scanning period (including the scanning period for the scanning signal lines 16*a* and 16*b*), supplied with a data signal of a negative polarity during the (k+1)th horizontal scanning period (including the scanning period for the scanning signal lines 16*c* and 16*d*), and also supplied with a data signal of a negative polarity during the (k+2)th horizontal scanning period (including the scanning period for the scanning signal lines 16*e* and 16*f*).

On the other hand, in F2, the data signal line 15*p*, the data signal line 15Q, and the data signal line 15*r* are each supplied with a data signal of a negative polarity during the kth horizontal scanning period (including the scanning period for the scanning signal lines 16*a* and 16*b*), supplied with a data signal of a negative polarity during the (k+1)th horizontal scanning period (including the scanning period for the scanning signal lines 16*c* and 16*d*), and also supplied with a data signal of a negative polarity during the (k+2)th horizontal scanning period (including the scanning period for the scanning signal lines 16*e* and 16*f*). Meanwhile, the data signal line 15P, the data signal line 15*q*, and the data signal line 15R are each supplied with a data signal of a positive polarity during the kth horizontal scanning period (including the scanning period for the scanning signal lines 16*a* and 16*b*), supplied with a data signal of a positive polarity during the (k+1)th horizontal scanning period (including the scanning period for the scanning signal lines 16*c* and 16*d*), and also supplied with a data signal of a positive polarity during the (k+2)th horizontal scanning period (including the scanning period for the scanning signal lines 16*e* and 16*f*).

It should be noted here that the image of FIG. 31 is displayed (a) by, during the kth horizontal scanning period, supplying the pixel electrodes 17*a* and 17*b*, respectively connected to the scanning signal lines 16*a* and 16*b* simultaneously selected, with data signals (the pixel electrode 17*a* being supplied with a data signal of a negative polarity corresponding to gray, the pixel electrode 17*b* being supplied with a data signal of a positive polarity corresponding to gray) of opposite polarities and of equal magnitude (absolute value of voltage), (b) by, during the (k+1)th horizontal scanning period, supplying the pixel electrodes 17*c* and 17*d*, respectively connected to the scanning signal lines 16*c* and 16*d* simultaneously selected, with data signals (the pixel electrode 17*c* being supplied with a data signal of a negative polarity corresponding to white, the pixel electrode 17*d* being supplied with a data signal of a positive polarity corresponding to black) of opposite polarities and of different in magnitude (absolute value of voltage), and (c) by, during the (k+2)th horizontal scanning period, supplying the pixel electrodes 17*e* and 17*f*, respectively connected to the scanning signal lines 16*e* and 16*f* simultaneously selected, with data signals (the pixel electrode 17*e* being supplied with a data signal of a negative polarity corresponding to gray, the pixel electrode 17*f* being supplied with a data signal of a positive polarity corresponding to gray) of opposite in polarities and of equal magnitude (absolute value of voltage).

Thus, the data signal line 15*q* is supplied with a data signal of a negative polarity corresponding to gray during the kth horizontal scanning period, is supplied with a data signal of a negative polarity corresponding to white during the (k+1)th horizontal scanning period, and is supplied with a data signal of a negative polarity corresponding to gray during the (k+2) th horizontal scanning period. Meanwhile, the data signal line 15Q is supplied with a data signal of a positive polarity corresponding to gray during the kth horizontal scanning period, is supplied with a data signal of a positive polarity corresponding to black during the (k+1)th horizontal scanning period, and is supplied with a data signal of a positive polarity corresponding to gray during the (k+2)th horizontal scanning period. That is, at the transition from the kth horizontal scanning period to the (k+1)th horizontal scanning period, the potentials of the data signals that are supplied to the data signal lines 15*q* and 15Q change in a falling direction (negative direction), and at the transition from the (k+1)th horizontal scanning period to the (k+2)th horizontal scanning period, the potentials of the data signals that are supplied to the data signal lines 15*q* and 15Q change in a rising direction (positive direction).

For this reason, in the pixel electrode 17*a*, for example, the pixel potential Va (data signal of a negative polarity corresponding to gray) written during the kth horizontal scanning period changes in a falling direction (negative direction) in the (k+1)th horizontal scanning period due to the parasitic capacitances Csd_aq and Csd_aQ between the pixel electrode 17*a* and the data signal lines 15*q* and 15Q, respectively, and changes in a rising direction (positive direction) in the (k+2)th horizontal scanning period due to the parasitic capacitances Csd_aq and Csd_aQ between the pixel electrode 17*a* and the data signal lines 15*q* and 15Q, respectively (see FIG. 34). Similarly, in the pixel electrode 17*b*, the pixel potential Vb (data signal of a positive polarity corresponding to gray) written during the kth horizontal scanning period changes in a falling direction (negative direction) in the (k+1)th horizontal scanning period due to the parasitic capacitances Csd_bq and Csd_bQ between the pixel electrode 17*b* and the data signal lines 15*q* and 15Q, respectively, and changes in a rising direction (positive direction) in the (k+2)th horizontal scanning period due to the parasitic capacitances Csd_aq and Csd_aQ between the pixel electrode 17*b* and the data signal lines 15*q* and 15Q, respectively (see FIG. 34).

Meanwhile, in the pixel electrode 17*e*, the pixel potential Ve (data signal of a positive polarity corresponding to gray) written during the previous frame period changes in a falling direction (negative direction) in the (k+1)th horizontal scanning period due to the parasitic capacitances Csd_eq and Csd_eQ (not illustrated) between the pixel electrode 17*e* and the data signal lines 15*q* and 15Q, respectively (see FIG. 34). Similarly, in the pixel electrode 17*f*, the pixel potential Vf (data signal of a negative polarity corresponding to gray) written during the previous frame period changes in a falling direction (negative direction) in the (k+1)th horizontal scanning period due to the parasitic capacitances Csd_fq and Csd_fQ (not illustrated) between the pixel electrode 17*f* and the data signal lines 15*q* and 15Q, respectively (see FIG. 34).

For this reason, as shown in FIG. 35, the pixel a, which contains the pixel electrode 17*a*, produces a brighter display (brighter gray) than it is supposed to produce, and the pixel b, which contains the pixel electrode 17*b*, produces a darker display (darker gray) than it is supposed to produce. Further, the pixel e, which contains the pixel electrode 17*e*, produces a darker display (darker gray) than it is supposed to produce, and the pixel f, which contains the pixel electrode 17*f*, produces a brighter display (brighter gray) than it is supposed to produce. This is how the display image exhibits unevenness and/or flickering. Such display unevenness appears more prominently in an image having a pattern of more stripes as shown in FIG. 30.

In view of the foregoing problems, the present invention has as an object to enhance the display quality of a display device having a plurality of data signal lines provided for each column of pixels.

Solution to Problem

In order to solve the foregoing problems, a display device according to the present invention is a display device including: a plurality of scanning signal lines; and a plurality of data signal lines, two of which are provided for each column of pixels containing a plurality of pixels arranged in a column-wise direction in which the data signal lines extend, in each column of pixels, a pixel electrode contained in either of two pixels adjacent to each other in the column-wise direction and a pixel electrode contained in the other one of the two pixels adjacent to each other being connected to different data signal lines via transistors, respectively, for a first, a second, and a third columns of pixels arranged in sequence, each pixel electrode contained in the second column of pixels forming a capacitance with either of the two data signal lines provided for the first column of pixels and forming a capacitance with either of the two data signal lines provided for the third column of pixels.

According to the foregoing configuration, the influence of a crosstalk due to parasitic capacitances formed between each pixel electrode and data signal lines corresponding to the pixel, respectively, can be curbed by capacitances formed between that pixel electrode and data signal lines corresponding to both adjacent columns of pixels, respectively. This makes it possible to suppress a change in pixel potential in each pixel electrode and thus enhance the display quality of the liquid crystal display apparatus.

Advantageous Effects of Invention

As described above, a liquid crystal device according to the present invention is configured such that for a first, a second, and a third columns of pixels arranged in sequence, each pixel electrode contained in the second column of pixels forms a capacitance with either of the two data signal lines provided for the first column of pixels and forms a capacitance with either of the two data signal lines provided for the third column of pixels. This makes it possible to enhance the display quality of a display device having a plurality of data signal lines provided for each column of pixels.

DESCRIPTION OF EMBODIMENTS

Examples of embodiments according to the present invention are described below with reference to the drawings. For convenience of explanation, the following description assumes that the term "column-wise direction" means the direction in which the data signal lines extend and the term "row-wise direction" means the direction in which the scanning signal lines extend. Note, however, that depending on how the present liquid crystal display apparatus (or the liquid crystal panel and the active-matrix substrate that are used in the present liquid crystal display apparatus) is used (viewed), the scanning signal lines may extend in a transverse direction or in a longitudinal direction. Note, also, that each pixel region of the active-matrix substrate corresponds to a single pixel of the liquid crystal panel.

Figure 1:
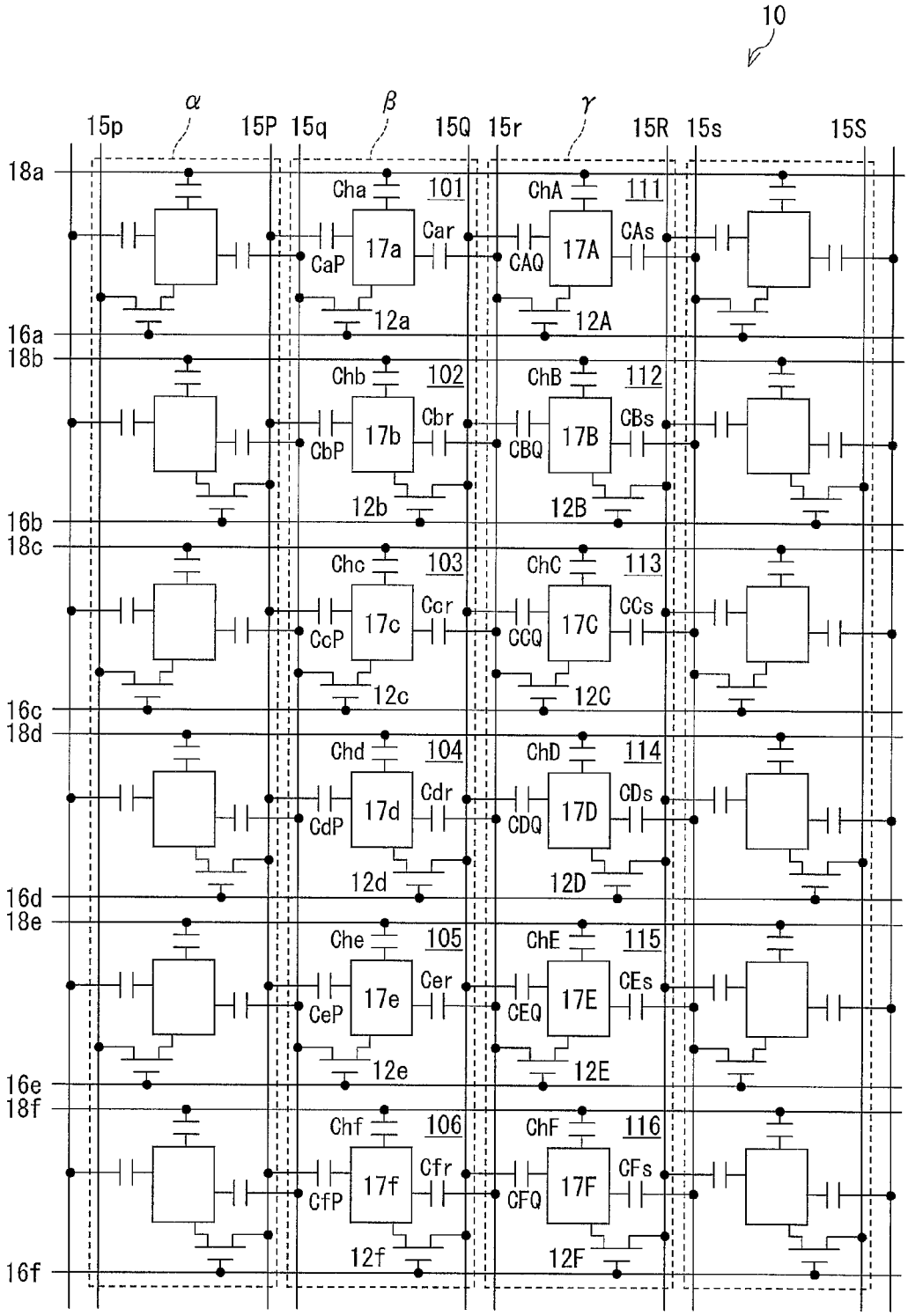
FIG. 1 is an equivalent circuit diagram showing part of a liquid crystal panel (Example Configuration 1) according to the present embodiment.

FIG. 1 is an equivalent circuit diagram showing part of a liquid crystal panel according to the present embodiment. As shown in FIG. 1, the present liquid crystal panel 10 has data signal lines 15*p*, 15P, 15*q*, 15Q, 15*r*, 15R, 15*s*, and 15S arranged in this order, and has scanning signal lines 16*a*, 16*b*, 16*c*, 16*d*, 16*e*, and 16*f* extending in the row-wise direction (in the drawing, a horizontal direction) and arranged in this order. The present liquid crystal panel 10 has a pixel 101 provided at intersections between the data signal lines 15*q* and 15Q and the scanning signal line 16*a*, a pixel 102 provided at intersections between the data signal lines 15*q* and 15Q and the scanning signal line 16*b*, and a pixel 103 provided at intersections between the data signal lines 15*q* and 15Q and the scanning signal line 16*c*. The present liquid crystal panel 10 also has pixels 104, 105, and 106 provided in similar manners.

Further, the present liquid crystal panel 10 has a pixel 111 provided at intersections between the data signal lines 15*r* and 15R and the scanning signal line 16*a*, a pixel 112 provided at intersections between the data signal lines 15*r* and 15R and the scanning signal line 16*b*, and a pixel 113 provided at intersections between the data signal lines 15*r* and 15R and the scanning signal line 16*c*. The present liquid crystal panel 10 also has pixels 114, 115, and 116 provided in similar manners.

The present liquid crystal panel 10 has a retention capacitor wire 18*a* provided for the pixels 101 and 111, a retention capacitor wire 18*b* provided for the pixels 102 and 112, a retention capacitor wire 18*c* provided for the pixels 103 and 113, a retention capacitor wire 18*d* provided for the pixels 104 and 114, a retention capacitor wire 18*e* provided for the pixels 105 and 115, and a retention capacitor wire 18*f* provided for the pixels 106 and 116.

It should be noted here that the data signal lines 15*p* and 15P correspond to a column of pixels α (first column of pixels) containing a plurality of pixels arranged in the column-wise direction, that the data signal lines 15*q* and 15Q correspond to a column of pixels β (second column of pixels) containing the pixels 101 to 106, and that the data signal lines 15*r* and 15R correspond to a column of pixels γ (third column of pixels) containing the pixels 111 to 116.

Furthermore, each pixel is provided with a pixel electrode. The pixel 101 has its pixel electrode 17*a* connected to the data signal line 15*q* via a transistor 12*a* connected to the scanning signal line 16*a*. The pixel 102 has its pixel electrode 17*b* connected to the data signal line 15Q via a transistor 12*b* connected to the scanning signal line 16*b*. The pixel 103 has its pixel electrode 17*c* connected to the data signal line 15*q* via a transistor 12*c* connected to the scanning signal line 16*c*. The pixel 104 has its pixel electrode 17*d* connected to the data signal line 15Q via a transistor 12*d* connected to the scanning signal line 16*d*. The pixel 105 has its pixel electrode 17*e* connected to the data signal line 15*q* via a transistor 12*e* connected to the scanning signal line 16*e*. The pixel 106 has its pixel electrode 17*f* connected to the data signal line 15Q via a transistor 12*f* connected to the scanning signal line 16*f*.

Meanwhile, the pixel 111 has its pixel electrode 17A connected to the data signal line 15*r* via a transistor 12A connected to the scanning signal line 16*a*. The pixel 112 has its pixel electrode 17B connected to the data signal line 15R via a transistor 12B connected to the scanning signal line 16*b*. The pixel 113 has its pixel electrode 17C connected to the data signal line 15*r* via a transistor 12C connected to the scanning signal line 16*c*. The pixel 114 has its pixel electrode 17D connected to the data signal line 15R via a transistor 12D connected to the scanning signal line 16*d*. The pixel 115 has its pixel electrode 17E connected to the data signal line 15*r* via a transistor 12E connected to the scanning signal line 16*e*. The pixel 116 has its pixel electrode 17F connected to the data signal line 15R via a transistor 12F connected to the scanning signal line 16*f*.

That is, the data signal line 15Q, connected to the respective pixel electrodes (17*b*, 17*d*, 17*f*) of the even-numbered pixels (102, 104, 106) of the column of pixels β, and the data signal line 15*r*, connected to the respective pixel electrodes (17*a*, 17*c*, 17*e*) of the odd-numbered pixels (111, 113, 115) of the column of pixels γ, are adjacent to each other.

Further, the scanning signal line 16*a*, which corresponds to the pixel electrode 17*a* of the pixel 101 and the pixel electrode 17A of the pixel 111, and the scanning signal line 16*b*, which corresponds to the pixel electrode 17*b* of the pixel 102 and the pixel electrode 17B of the pixel 112, are electrically connected to each other inside or outside of the panel, so that the scanning signal lines 16*a* and 16*b* are simultaneously selected. Further, the scanning signal line 16*c*, which corresponds to the pixel electrode 17*c* of the pixel 103 and the pixel electrode 17C of the pixel 113, and the scanning signal line 16*d*, which corresponds to the pixel electrode 17*d* of the pixel 104 and the pixel electrode 17D of the pixel 114, are electrically connected to each other inside or outside of the panel, so that the scanning signal lines 16*c* and 16*d* are simultaneously selected. Further, the scanning signal line 16*e*, which corresponds to the pixel electrode 17*e* of the pixel 105 and the pixel electrode 17E of the pixel 115, and the scanning signal line 16*f*, which corresponds to the pixel electrode 17*f* of the pixel 106 and the pixel electrode 17F of the pixel 116, are electrically connected to each other inside or outside of the panel, so that the scanning signal lines 16*e* and 16*f* are simultaneously selected. It should be noted that a configuration is possible in which each of the pairs of scanning signal lines, namely the scanning signal lines 16*a* and 16*b*, the scanning signal lines 16*c* and 16*d*, or the scanning signal lines 16*e* and 16*f*, are simultaneously selected without being electrically connected to each other inside or outside of the panel.

The liquid crystal panel 10 thus configured has a retention capacitance Cha formed between the retention capacitor wire 18*a* and the pixel electrode 17*a*, a retention capacitance Chb formed between the retention capacitor wire 18*b* and the pixel electrode 17*b*, a retention capacitance Chc formed between the retention capacitor wire 18*c* and the pixel electrode 17*c*, a retention capacitance Chd formed between the retention capacitor wire 18*d* and the pixel electrode 17*d*, a retention capacitance Che formed between the retention capacitor wire 18*e* and the pixel electrode 17*e*, and a retention capacitance Chf formed between the retention capacitor wire 18*f* and the pixel electrode 17*f*. Similarly, the liquid crystal panel 10 thus configured has a retention capacitance ChA formed between the retention capacitor wire 18*a* and the pixel electrode 17A, a retention capacitance ChB formed between the retention capacitor wire 18*b* and the pixel electrode 17B, a retention capacitance ChC formed between the retention capacitor wire 18*c* and the pixel electrode 17C, a retention capacitance ChD formed between the retention capacitor wire 18*d* and the pixel electrode 17D, a retention capacitance ChE formed between the retention capacitor wire 18*e* and the pixel electrode 17E, and a retention capacitance ChF formed between the retention capacitor wire 18*f* and the pixel electrode 17F.

Figure 33:
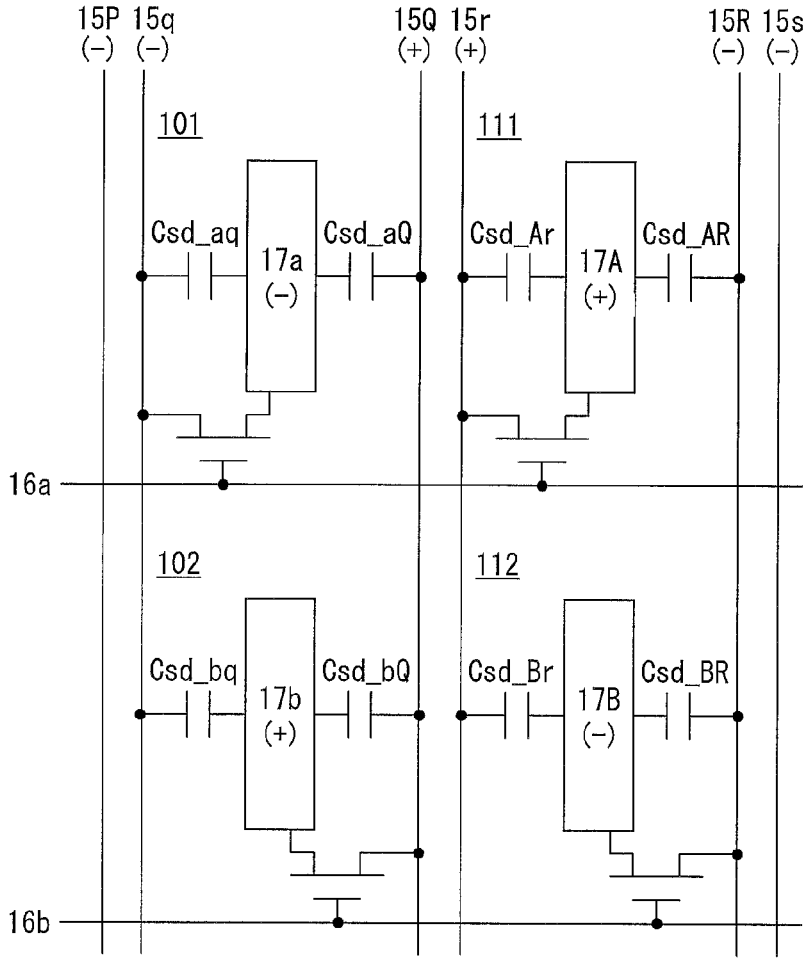
FIG. 33 PRIOR ART
FIG. 33 is an equivalent circuit diagram showing the appearance of parasitic capacitances produced in pixels 101, 102, 111, and 112 of a conventional liquid crystal panel.

As shown in FIG. 33, parasitic capacitances are produced between the pixel electrodes and the data signal lines for structural reasons. That is, the pixel 101 has the parasitic capacitance Csd_aq produced between the pixel electrode 17*a* and the data signal line 15*q* and the parasitic capacitance Csd_aQ produced between the pixel electrode 17*a* and the data signal line 15Q. The pixel 102 has the parasitic capacitance Csd_bq produced between the pixel electrode 17*b* and the data signal line 15*q* and the parasitic capacitance Csd_bQ produced between the pixel electrode 17*b* and the data signal line 15Q. The pixel 111 has a parasitic capacitance Csd_Ar produced between the pixel electrode 17A and the data signal line 15*r* and a parasitic capacitance Csd_AR produced between the pixel electrode 17A and the data signal line 15R. The pixel 112 has a parasitic capacitance Csd_Br produced between the pixel electrode 17B and the data signal line 15*r* and a parasitic capacitance Csd_BR produced between the pixel electrode 17B and the data signal line 15R. For convenience, FIG. 1 omits to illustrate the parasitic capacitances.

Figure 34:
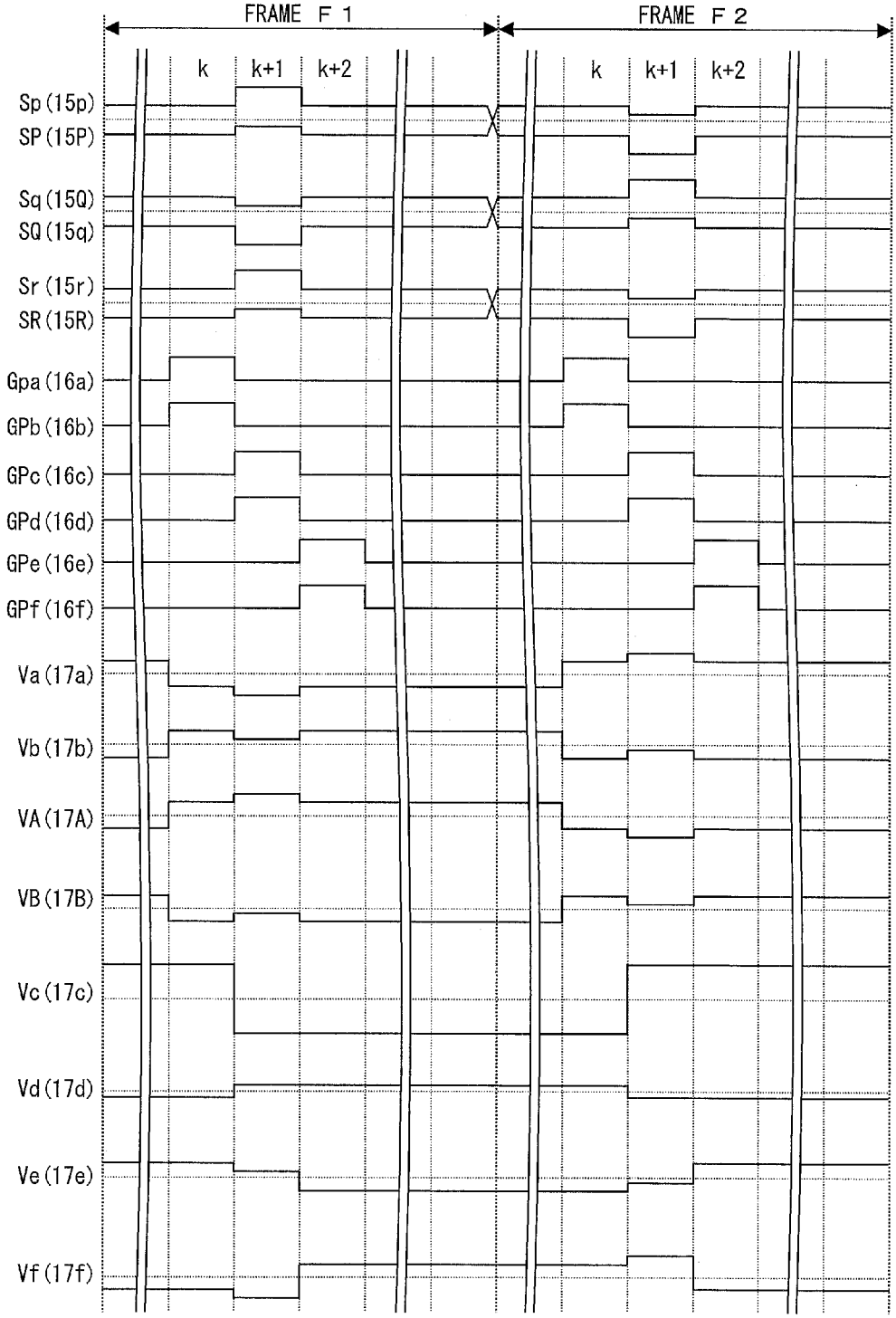
FIG. 34 PRIOR ART
FIG. 34 is a timing chart showing a method for driving a liquid crystal panel in displaying the image of FIG. 31.
Figure 35:
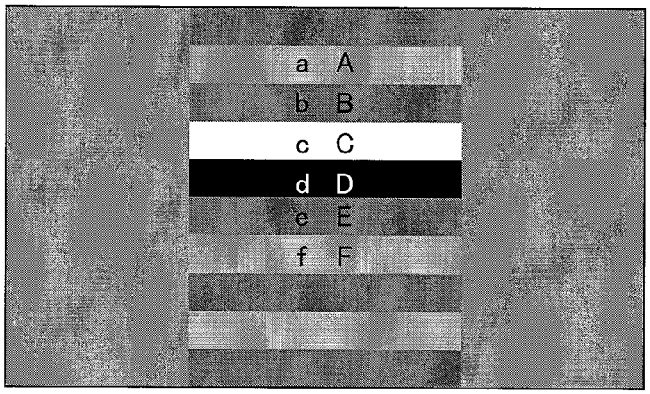
FIG. 35 PRIOR ART
FIG. 35 is a diagram showing a display image that is displayed by the driving method of FIG. 34.

Due to such structural parasitic capacitances, there has conventionally been such a problem that changes in pixel potential after writing of data signals to the pixel electrodes cause display unevenness (see FIGS. 34 and 35).

In view of this problem, the present invention has a configuration in which such changes in pixel potential are suppressed by each pixel electrode's forming a capacitance with each of the data signal lines respectively corresponding to both adjacent columns of pixels.

Specifically, FIG. 1 shows that the pixel 101 has a capacitance CaP formed between the pixel electrode 17*a* and the data signal line 15P and a capacitance Car formed between the pixel electrode 17*a* and the data signal line 15*r*, that the pixel 102 has a capacitance CbP formed between the pixel electrode 17*b* and the data signal line 15P and a capacitance Cbr formed between the pixel electrode 17*b* and the data signal line 15*r*, that the pixel 103 has a capacitance CcP formed between the pixel electrode 17*c* and the data signal line 15P and a capacitance Ccr formed between the pixel electrode 17*c* and the data signal line 15*r*, that the pixel 104 has a capacitance CdP formed between the pixel electrode 17*d* and the data signal line 15P and a capacitance Cdr formed between the pixel electrode 17*d* and the data signal line 15*r*, that the pixel 105 has a capacitance CeP formed between the pixel electrode 17*e* and the data signal line 15P and a capacitance Cer formed between the pixel electrode 17*e* and the data signal line 15*r*, and that the pixel 106 has a capacitance CfP formed between the pixel electrode 17*f* and the data signal line 15P and a capacitance Cfr formed between the pixel electrode 17*f* and the data signal line 15*r*.

Similarly, the pixel 111 has a capacitance CAQ formed between the pixel electrode 17A and the data signal line 15Q and a capacitance CAs formed between the pixel electrode 17A and the data signal line 15*s*. The pixel 112 has a capacitance CBQ formed between the pixel electrode 17B and the data signal line 15Q and a capacitance CBs formed between the pixel electrode 17B and the data signal line 15*s*. The pixel 113 has a capacitance CCQ formed between the pixel electrode 17C and the data signal line 15Q and a capacitance CCs formed between the pixel electrode 17C and the data signal line 15*s*. The pixel 114 has a capacitance CDQ formed between the pixel electrode 17*d* and the data signal line 15Q and a capacitance CDs formed between the pixel electrode 17D and the data signal line 15*s*. The pixel 115 has a capacitance CEQ formed between the pixel electrode 17E and the data signal line 15Q and a capacitance CEs formed between the pixel electrode 17E and the data signal line 15*s*. The pixel 116 has a capacitance CFQ formed between the pixel electrode 17F and the data signal line 15Q and a capacitance CFs formed between the pixel electrode 17F and the data signal line 15*s*.

Figure 2:
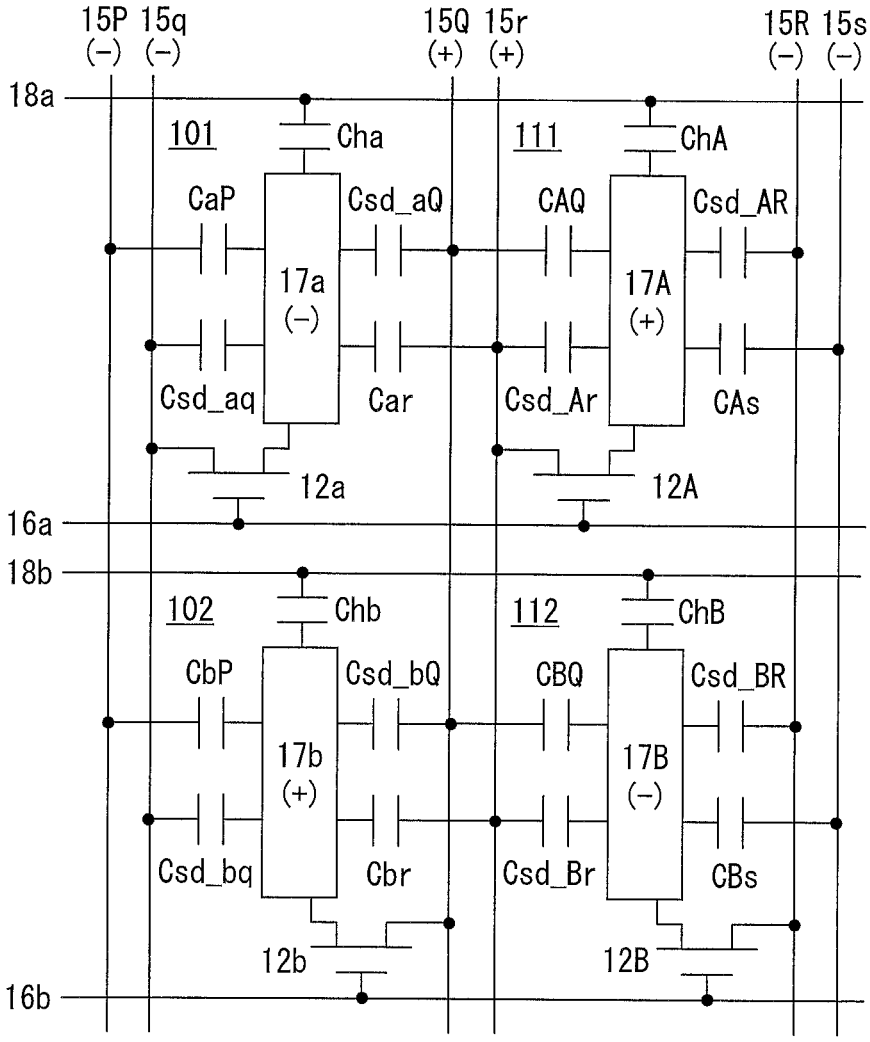
FIG. 2 is an equivalent circuit diagram showing the appearance of capacitances formed in pixels 101, 102, 111, and 112 of the liquid crystal panel of FIG. 1.

FIG. 2 is an equivalent circuit diagram showing the appearance of the capacitances formed in the pixels 101, 102, 111, and 112 of the present liquid crystal panel. As shown in FIG. 2, each pixel electrode forms parasitic capacitances with the data signal lines corresponding to the pixel, respectively, and forms capacitances with the data signal lines corresponding to both adjacent columns of pixels, respectively. For example, the pixel electrode 17*b* forms the parasitic capacitances Csd_bq and Csd_bQ with the data signal lines 15*q* and 15Q corresponding to the pixel 102, respectively, and forms the capacitances CbP and Cbr with the data signal lines 15P and 15*r* corresponding to both adjacent columns of pixels α and γ, respectively.

(Method for Driving a Liquid Crystal Panel)

Figure 3:
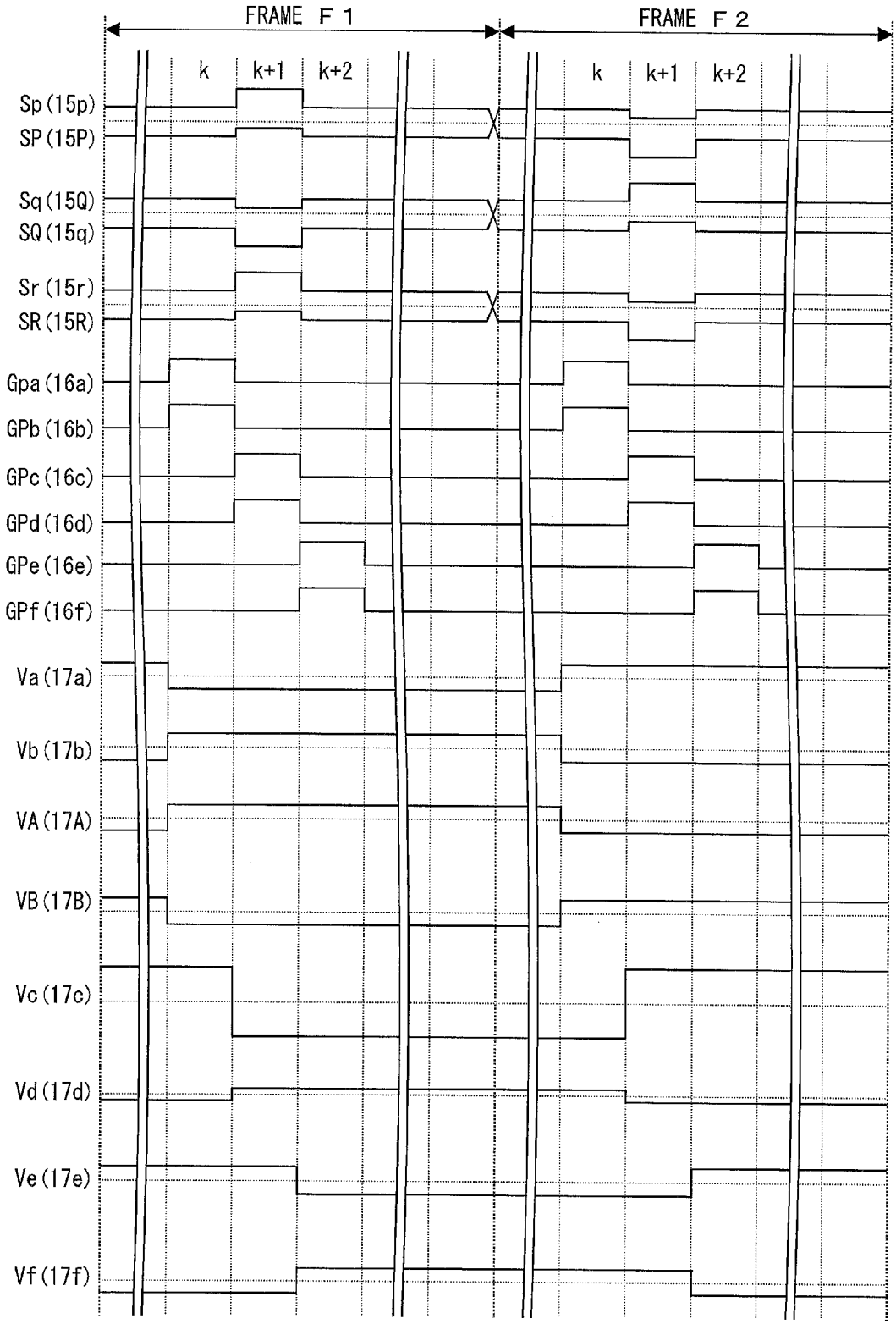
FIG. 3 is a timing chart showing a method for driving the liquid crystal panel of FIG. 1.

FIG. 3 is a timing chart showing a method (normally black mode) for driving the liquid crystal panel of FIG. 1. It should be noted that the reference sings Sp, SP, Sq, SQ, Sr, and SR refer to data signals that are supplied to the data signal lines 15*p*, 15P, 15*q*, 15Q, 15*r*, and 15R (see FIG. 1), respectively, that the reference signs GPa, GPb, GPc, GPd, GPe, and GPf refer to gate signals (scanning signals) that are supplied to the scanning signal lines 16*a*, 16*b*, 16*c*, 16*d*, 16*e*, and 16*f* (see FIG. 1), respectively, and that the reference signs Va, Vb, VA, VB, Vc, Vd, Ve, and Vf refer to potentials (pixel potentials) of the pixels electrodes 17*a*, 17*b*, 17A, 17B, 17*c*, 17*d*, 17*e*, and 17*f* (see FIG. 1), respectively.

According to the present driving method, as shown in FIG. 3, two scanning signals are simultaneously selected at a time and each data signal line is supplied with a data signal whose polarity is reversed every single frame period, and during the same horizontal scanning period, two data signal lines (15*p* and 15P, 15*q* and 15Q, 15*r* and 15R) corresponding to the same column of pixels are supplied with data signals of opposite polarities while two adjacent data signal lines (15P and 15*q*, 15Q and 15*r*, 15R and 15*s*) are supplied with data signals of the same polarity.

Specifically, in F1, of the consecutive frames F1 and F2, the data signal line 15*p*, the data signal line 15Q, and the data signal line 15*r* are each supplied with a data signal of a positive polarity during the kth horizontal scanning period (including the scanning period for the scanning signal lines 16*a* and 16*b*), supplied with a data signal of a positive polarity during the (k+1)th horizontal scanning period (including the scanning period for the scanning signal lines 16*c* and 16*d*), and also supplied with a data signal of a positive polarity during the (k+2)th horizontal scanning period (including the scanning period for the scanning signal lines 16*e* and 16*f*). Meanwhile, the data signal line 15P, the data signal line 15*q*, and the data signal line 15R are each supplied with a data signal of a negative polarity during the kth horizontal scanning period (including the scanning period for the scanning signal lines 16*a* and 16*b*), supplied with a data signal of a negative polarity during the (k+1)th horizontal scanning period (including the scanning period for the scanning signal lines 16*c* and 16*d*), and also supplied with a data signal of a negative polarity during the (k+2)th horizontal scanning period (including the scanning period for the scanning signal lines 16*e* and 16*f*). Moreover, at the same time as the start of the kth horizontal scanning period, a pulse of the gate pulse signal (gate-on pulse signal) GPa and a pulse of the gate pulse signal GPb are raised. At the same time as the start of the (k+1)th horizontal scanning period (i.e., as the end of the kth horizontal scanning period), the pulses of GPa and GPb are dropped and a pulse of the gate pulse signal GPc and a pulse of the gate pulse signal GPd are raised. At the same time as the start of the (k+2)th horizontal scanning period (i.e., as the end of the (k+1)th horizontal scanning period), the pulses of GPc and GPd are dropped and a pulse of the gate pulse signal GPe and a pulse of the gate pulse signal GPf are raised.

Figure 4:
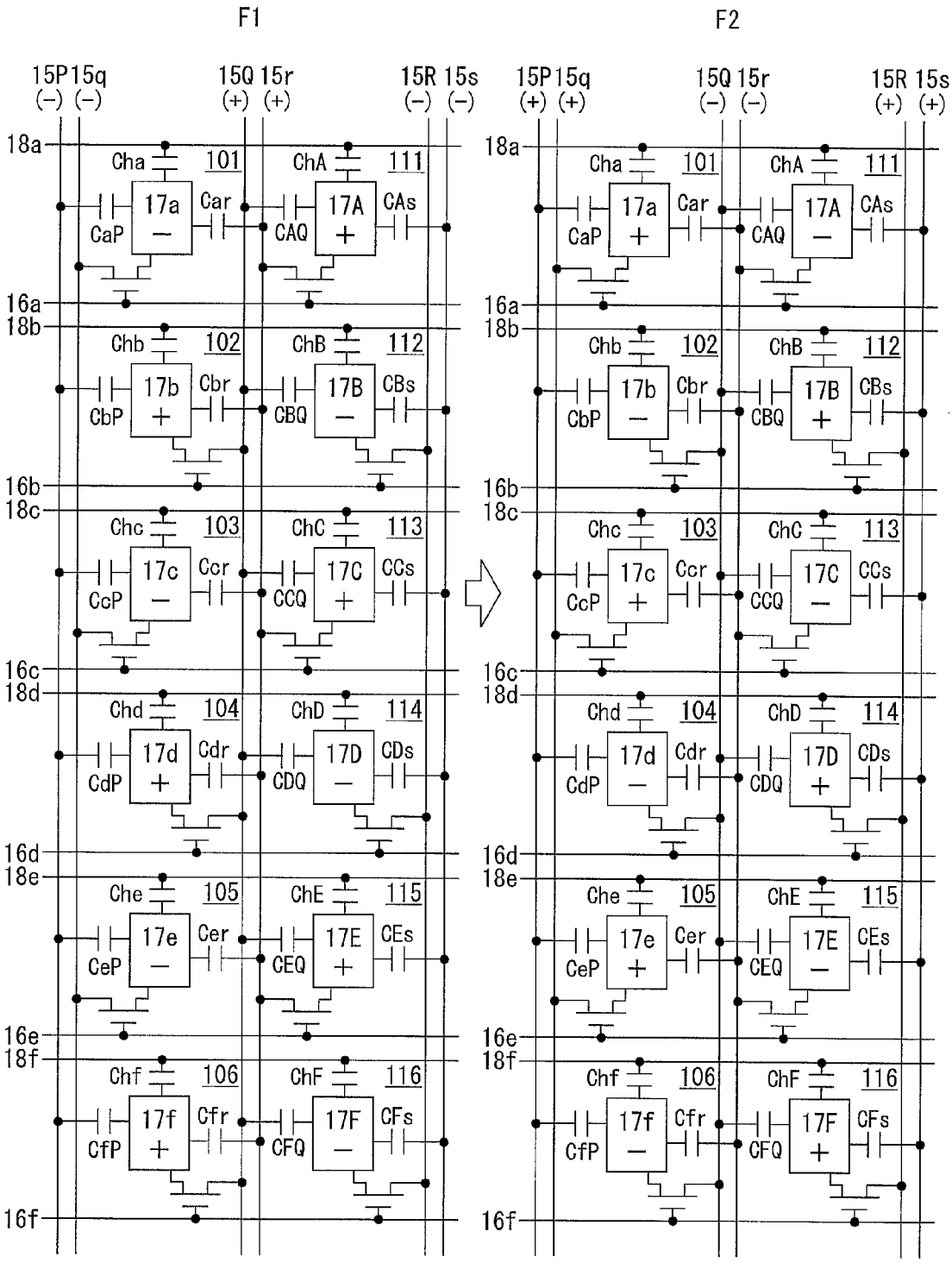
FIG. 4 is a schematic view showing a display state of the liquid crystal panel by the driving method of FIG. 3.

Thus, as shown in the frame F1 of FIG. 4, a data signal of a negative polarity, a data signal of a positive polarity, a data signal of a negative polarity, a data signal of a positive polarity, a data signal of a negative polarity, and a data signal of a positive polarity are written to the pixel electrode 17*a* of the pixel 101, the pixel electrode 17*b* of the pixel 102, the pixel electrode 17*c* of the pixel 103, the pixel electrode 17*d* of the pixel 104, the pixel electrode 17*e* of the pixel 105, and the pixel electrode 17*f* of the pixel 106, respectively. Similarly, a data signal of a positive polarity, a data signal of a negative polarity, a data signal of a positive polarity, a data signal of a negative polarity, a data signal of a positive polarity, and a data signal of a negative polarity are written to the pixel electrode 17A of the pixel 111, the pixel electrode 17B of the pixel 112, the pixel electrode 17C of the pixel 113, the pixel electrode 17D of the pixel 114, the pixel electrode 17E of the pixel 115, and the pixel electrode 17F of the pixel 116, respectively.

On the other hand, in F2, the data signal line 15*p*, the data signal line 15Q, and the data signal line 15*r* are each supplied with a data signal of a negative polarity during the kth horizontal scanning period (including the scanning period for the scanning signal lines 16*a* and 16*b*), supplied with a data signal of a negative polarity during the (k+1)th horizontal scanning period (including the scanning period for the scanning signal lines 16*c* and 16*d*), and also supplied with a data signal of a negative polarity during the (k+2)th horizontal scanning period (including the scanning period for the scanning signal lines 16*e* and 16*f*). Meanwhile, the data signal line 15P, the data signal line 15*q*, and the data signal line 15R are each supplied with a data signal of a positive polarity during the kth horizontal scanning period (including the scanning period for the scanning signal lines 16*a* and 16*b*), supplied with a data signal of a positive polarity during the (k+1)th horizontal scanning period (including the scanning period for the scanning signal lines 16*c* and 16*d*), and also supplied with a data signal of a positive polarity during the (k+2)th horizontal scanning period (including the scanning period for the scanning signal lines 16*e* and 16*f*). Moreover, at the same time as the start of the kth horizontal scanning period, the pulse of the gate pulse signal (gate-on pulse signal) GPa and the pulse of the gate pulse signal GPb are raised. At the same time as the start of the (k+1)th horizontal scanning period (i.e., as the end of the kth horizontal scanning period), the pulses of GPa and GPb are dropped and a pulse of the gate pulse signal GPc and a pulse of the gate pulse signal GPd are raised. At the same time as the start of the (k+2)th horizontal scanning period (i.e., as the end of the (k+1)th horizontal scanning period), the pulses of GPc and GPd are dropped and a pulse of the gate pulse signal GPe and a pulse of the gate pulse signal GPf are raised.

Thus, as shown in the frame F2 of FIG. 4, a data signal of a positive polarity, a data signal of a negative polarity, a data signal of a positive polarity, a data signal of a negative polarity, a data signal of a positive polarity, and a data signal of a negative polarity are written to the pixel electrode 17*a* of the pixel 101, the pixel electrode 17*b* of the pixel 102, the pixel electrode 17*c* of the pixel 103, the pixel electrode 17*d* of the pixel 104, the pixel electrode 17*e* of the pixel 105, and the pixel electrode 17*f* of the pixel 106, respectively. Similarly, a data signal of a negative polarity, a data signal of a positive polarity, a data signal of a negative polarity, a data signal of a positive polarity, a data signal of a negative polarity, and a data signal of a positive polarity are written to the pixel electrode 17A of the pixel 111, the pixel electrode 17B of the pixel 112, the pixel electrode 17C of the pixel 113, the pixel electrode 17D of the pixel 114, the pixel electrode 17E of the pixel 115, and the pixel electrode 17F of the pixel 116, respectively.

The above driving method achieves dot-reversal driving.

Figure 31:
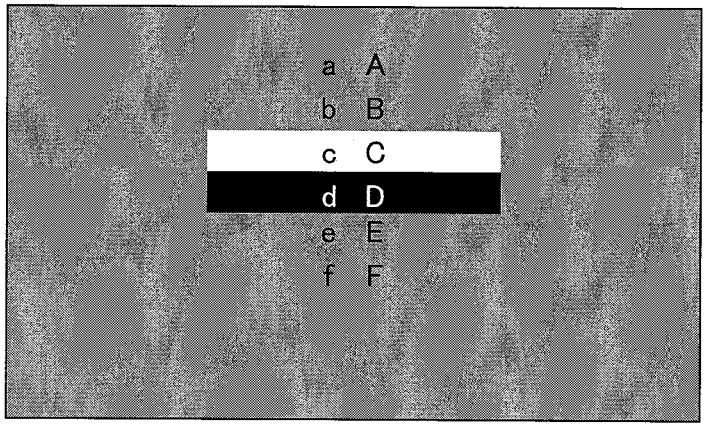
FIG. 31 is a diagram showing part of the image of FIG. 30.
Figure 32:
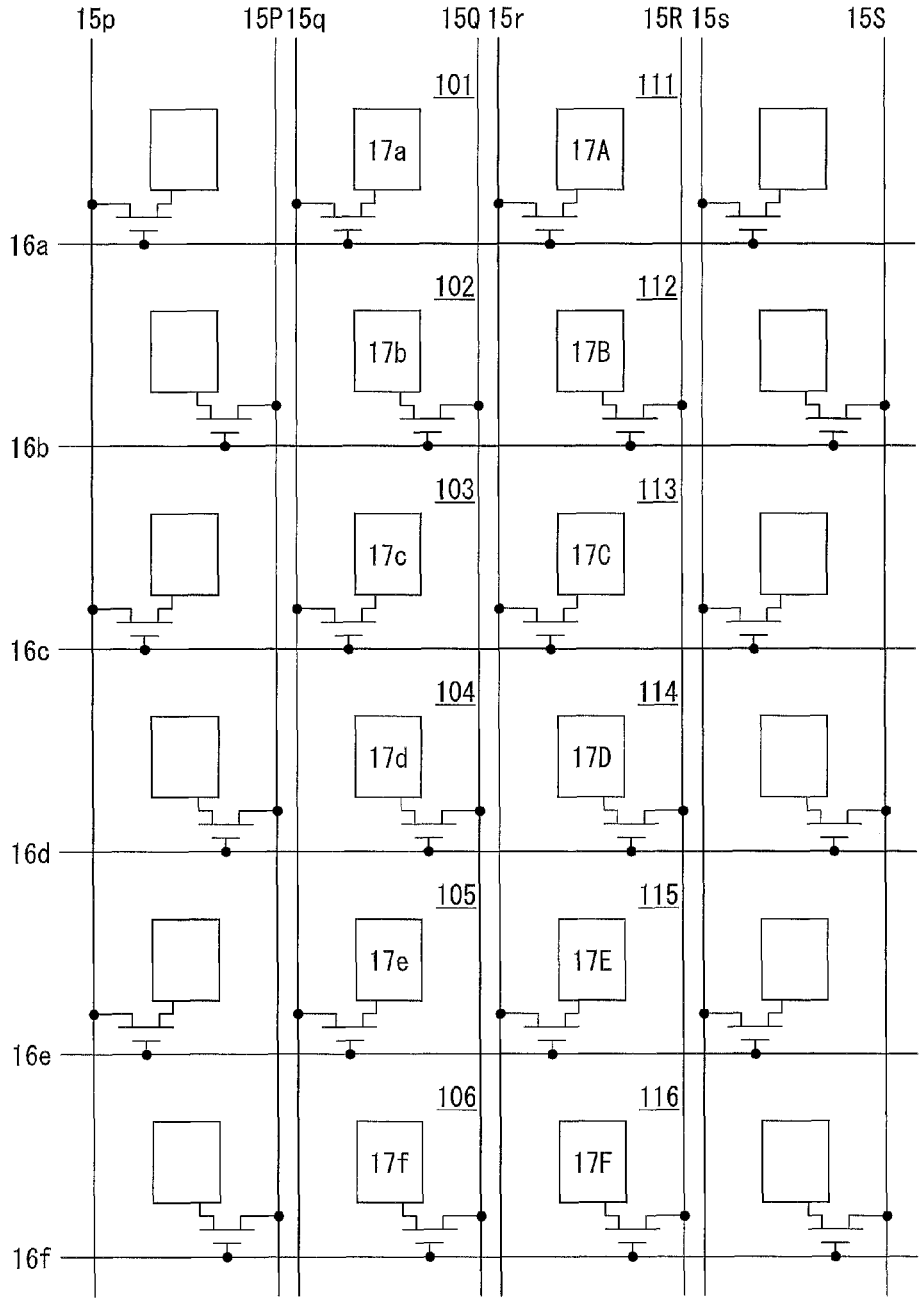
FIG. 32 PRIOR ART
FIG. 32 is an equivalent circuit diagram showing part of a configuration of a conventional liquid crystal panel.

It should be noted here that the image of FIG. 31 is displayed (a) by, during the kth horizontal scanning period, supplying the pixel electrodes 17*a* and 17*b*, respectively connected to the scanning signal lines 16*a* and 16*b* simultaneously selected, with data signals (the pixel electrode 17*a* being supplied with a data signal of a negative polarity corresponding to gray, the pixel electrode 17*b* being supplied with a data signal of a positive polarity corresponding to gray) of opposite polarities and of equal magnitude (absolute value of voltage), (b) by, during the (k+1)th horizontal scanning period, supplying the pixel electrodes 17*c* and 17*d*, respectively connected to the scanning signal lines 16*c* and 16*d* simultaneously selected, with data signals (the pixel electrode 17*c* being supplied with a data signal of a negative polarity corresponding to white, the pixel electrode 17*b* being supplied with a data signal of a positive polarity corresponding to black) of opposite polarities and of equal magnitude (absolute value of voltage), and (c) by, during the (k+2)th horizontal scanning period, supplying the pixel electrodes 17*e* and 17*f*, respectively connected to the scanning signal lines 16*e* and 16*f* simultaneously selected, with data signals (the pixel electrode 17*e* being supplied with a data signal of a negative polarity corresponding to gray, the pixel electrode 17*f* being supplied with a data signal of a positive polarity corresponding to gray) of opposite polarities and of equal magnitude (absolute value of voltage).

Thus, the data signal line 15*q* is supplied with a data signal of a negative polarity corresponding to gray during the kth horizontal scanning period, is supplied with a data signal of a negative polarity corresponding to white during the (k+1)th horizontal scanning period, and is supplied with a data signal of a negative polarity corresponding to gray during the (k+2) th horizontal scanning period. Meanwhile, the data signal line 15Q is supplied with a data signal of a positive polarity corresponding to gray during the kth horizontal scanning period, is supplied with a data signal of a positive polarity corresponding to black during the (k+1)th horizontal scanning period, and is supplied with a data signal of a positive polarity corresponding to gray during the (k+2)th horizontal scanning period. That is, at the transition from the kth horizontal scanning period to the (k+1)th horizontal scanning period, the potentials of the data signals that are supplied to the data signal lines 15*q* and 15Q change in a falling direction (negative direction), and at the transition from the (k+1)th horizontal scanning period to the (k+2)th horizontal scanning period, the potentials of the data signals that are supplied to the data signal lines 15*q* and 15Q change in a rising direction (positive direction).

For this reason, in the pixel electrode 17*a*, for example, the pixel potential Va (data signal of a negative polarity corresponding to gray) written during the kth horizontal scanning period changes in a falling direction (negative direction) in the (k+1)th horizontal scanning period due to the parasitic capacitances Csd_aq and Csd_aQ between the pixel electrode 17*a* and the data signal lines 15*q* and 15Q, respectively, and changes in a rising direction (positive direction) in the (k+2)th horizontal scanning period due to the parasitic capacitances Csd_aq and Csd_aQ between the pixel electrode 17*a* and the data signal lines 15*q* and 15Q, respectively (see FIG. 34).

In the present configuration, however, the pixel electrode 17*a* forms capacitances CaP and Car with the data signal lines 15P and 15*r*, respectively. The data signal line 15P is supplied with a data signal of a negative polarity corresponding to gray during the kth horizontal scanning period, is supplied with a data signal of a negative polarity corresponding to black during the (k+1)th horizontal scanning period, and is supplied with a data signal of a negative polarity corresponding to gray during the (k+2)th horizontal scanning period. The data signal line 15*r* is supplied with a data signal of a positive polarity corresponding to gray during the kth horizontal scanning period, is supplied with a data signal of a positive polarity corresponding to white during the (k+1)th horizontal scanning period, and is supplied with a data signal of a positive polarity corresponding to gray during the (k+2)th horizontal scanning period.

For this reason, in the pixel electrode 17*a*, the pixel potential Va (data signal of a negative polarity corresponding to gray) written during the kth horizontal scanning period changes in a rising direction (positive direction) in the (k+1)th horizontal scanning period due to the capacitances CaP and Car, and changes in a falling direction (negative direction) in the (k+2)th horizontal scanning period due to the capacitances CaP and Car. Thus, the changes in potential due to the parasitic capacitances can be canceled by the changes in potential due to the capacitances formed between the pixel electrode and the data signal lines corresponding to both adjacent columns of pixels, respectively. This makes it possible to curb the influence of a crosstalk and thus enhance display quality.

Similarly, in the pixel electrode 17*b*, the pixel potential Vb (data signal of a positive polarity corresponding to gray) written during the kth horizontal scanning period changes in a falling direction (negative direction) due to the parasitic capacitances Csd_bq and Csd_bQ between the pixel electrode 17*b* and the data signal lines 15*q* and 15Q, respectively (see FIG. 34), in the (k+1)th horizontal scanning period, but changes in a rising direction (positive direction) due to the capacitances CbP and Cbr in the (k+1)th horizontal scanning period, and changes in a rising direction (positive direction) due to the parasitic capacitances Csd_bq and Csd_bQ between the pixel electrode 17*b* and the data signal lines 15*q* and 15Q, respectively (see FIG. 34), in the (k+2)th horizontal scanning period, but changes in a falling direction (negative direction) due to the capacitances CbP and Cbr in the (k+2)th horizontal scanning period. Thus, the changes in potential due to the parasitic capacitances can be canceled by the changes in potential due to the capacitances formed between the pixel electrode and the data signal lines corresponding to both adjacent columns of pixels, respectively. This makes it possible to curb the influence of a crosstalk and thus enhance display quality.

(Example Configuration 1 of a Liquid Crystal Panel)

Figure 5:
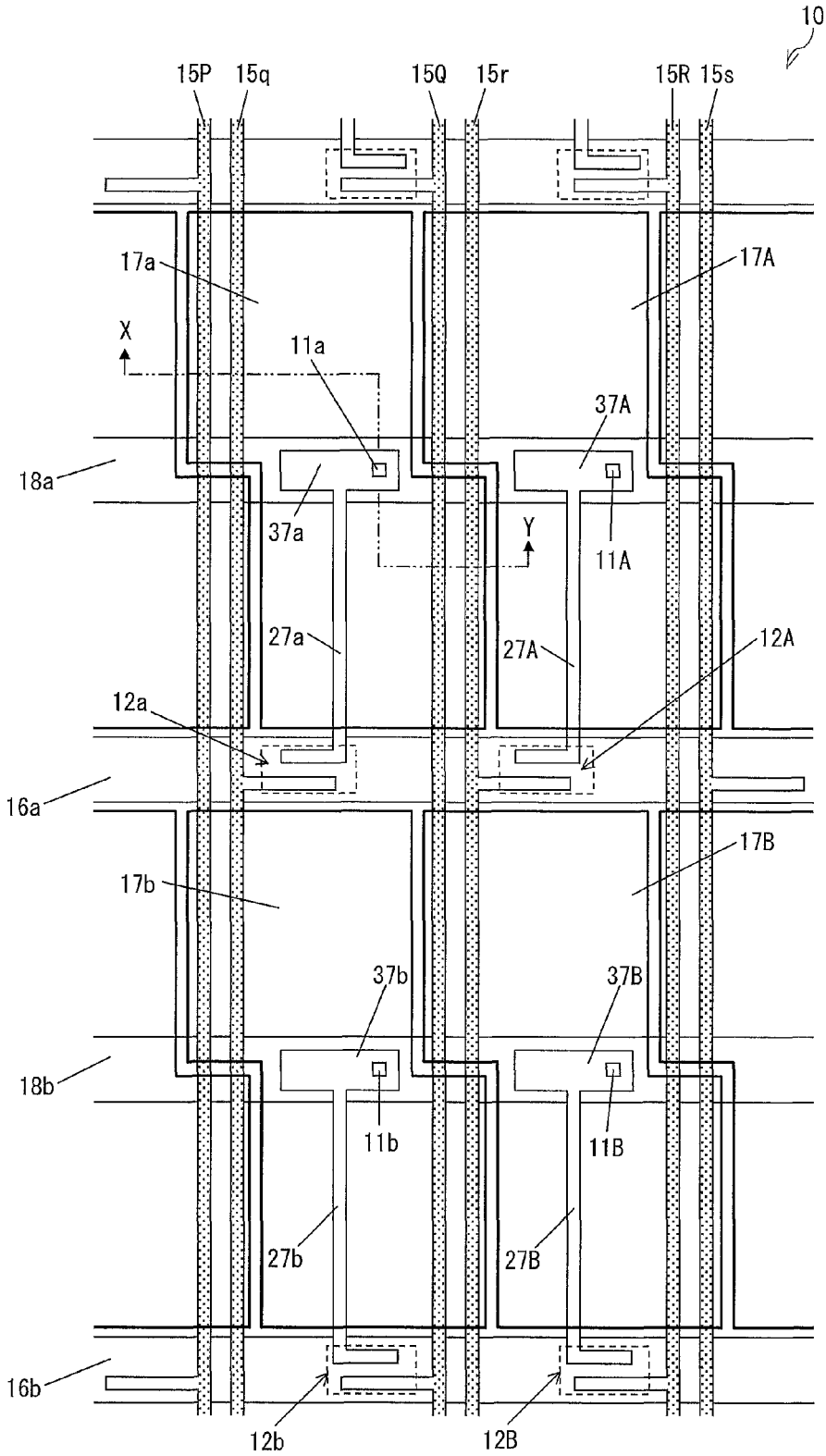
FIG. 5 is a plan view showing a configuration of the liquid crystal panel of FIG. 1.

FIG. 5 is a plan view showing a configuration of the liquid crystal panel of FIG. 1.

In Example Configuration 1, as shown in FIG. 5, the present liquid crystal panel 10 has a pair of (two) data signal lines 15*q* and 15Q and a pair of (two) data signal lines 15*r* and 15R provided so that the data signal line 15Q and the data signal line 15*r* are adjacent to each other, has scanning signal lines 16*a* and 16*b* provided in such a way as to be orthogonal to the data signal lines, has a transistor 12*a* provided near an intersection between the data signal line 15*q* and the scanning signal line 16*a*, has a transistor 12*b* provided near an intersection between the data signal line 15Q and the scanning signal line 16*b*, has a transistor 12A provided near an intersection between the data signal line 15*r* and the scanning signal line 16*a*, and has a transistor 12B provided near an intersection between the data signal line 15R and the scanning signal line 16*b*.

The present liquid crystal panel 10 has a pixel electrode 17*a* provided so that part thereof overlaps the data signal lines 15P, 15*q*, 15Q, and 15*r*, a pixel electrode 17*b* provided so that part thereof overlaps the data signal lines 15P, 15*q*, 15Q, and 15*r*, a pixel electrode 17A provided so that part thereof overlaps the data signal lines 15Q, 15*r*, 15R, and 15*s*, and a pixel electrode 17B provided so that part thereof overlaps the data signal lines 15Q, 15*r*, 15R, and 15*s*.

Further, the present liquid crystal panel 10 has a retention capacitor wire 18*a* provided in such a way as to overlap the pixel electrodes 17*a* and 17A and a retention capacitor wire 18*b* provided in such a way as to overlap the pixel electrodes 17*b* and 17B.

Moreover, the scanning signal line 16*a* functions as the gate electrode of the transistor 12*a*, which has its source electrode connected to the data signal line 15*q* and which has its drain electrode connected to a capacitor electrode 37*a* via a drain drawing electrode 27*a*. The capacitor electrode 37*a* is provided above the retention capacitor wire 18*a* and is connected to the pixel electrode 17*a* via a contact hole 11*a*. Further, the scanning signal line 16*b* functions as the gate electrode of the transistor 12*b*, which has its source electrode connected to the data signal line 15Q and which has its drain electrode connected to a capacitor electrode 37*b* via a drain drawing electrode 27*b*. The capacitor electrode 37*b* is provided above the retention capacitor wire 18*b* and is connected to the pixel electrode 17*b* via a contact hole 11*b*.

Similarly, the scanning signal line 16*a* functions as the gate electrode of the transistor 12A, which has its source electrode connected to the data signal line 15*r* and which has its drain electrode connected to a capacitor electrode 37A via a drain drawing electrode 27A. The capacitor electrode 37A is provided above the retention capacitor wire 18A and is connected to the pixel electrode 17A via a contact hole 11A. Further, the scanning signal line 16*b* functions as the gate electrode of the transistor 12B, which has its source electrode connected to the data signal line 15R and which has its drain electrode connected to a capacitor electrode 37B via a drain drawing electrode 27B. The capacitor electrode 37B is provided above the retention capacitor wire 18*b* and is connected to the pixel electrode 17B via a contact hole 11B.

The present liquid crystal panel 10 is configured such that the retention capacitance Cha (see FIG. 1) is formed in a portion where the retention capacitor wire 18*a* and the capacitor electrode 37*a* overlap each other via a gate insulating film, that the retention capacitance Chb (see FIG. 1) is formed in a portion where the retention capacitor wire 18*b* and the capacitor electrode 37*b* overlap each other via the gate insulating film, that the retention capacitance ChA (see FIG. 1) is formed in a portion where the retention capacitor wire 18*a* and the capacitor electrode 37A overlap each other via the gate insulating film, and that the retention capacitance ChB (see FIG. 1) is formed in a portion where the retention capacitor wire 18*b* and the capacitor electrode 37B overlap each other via the gate insulating film.

Figure 6:
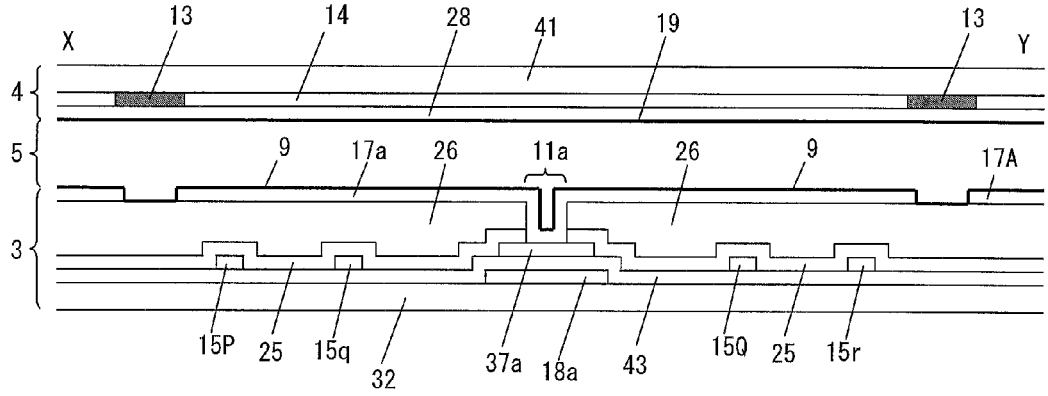
FIG. 6 is a cross-sectional view of the liquid crystal panel as taken along the arrow X-Y of FIG. 5.

FIG. 6 is a cross-sectional view taken along the arrow X-Y of FIG. 5. As shown in FIG. 6, the present liquid crystal panel 10 includes: an active-matrix substrate 3; a color filter substrate 4 placed opposite the active-matrix substrate 3; and a liquid crystal layer placed between the substrates 3 and 4. The active-matrix substrate 3 has a glass substrate 32 on which the scanning signal line 16*a* (not illustrated) and the retention capacitor wire 18*a* have been formed, with a gate insulating film 43 formed so as to cover the scanning signal line 16*a* and the retention capacitor wire 18*a*. Formed on the gate insulating film 43 are the capacitor electrode 37*a*, the data signal lines 15P, 15*q*, 15Q, and 15*r*, and the drain drawing electrode 27*a* (not illustrated). Further formed on the gate insulating film 43 are semiconductor layers (an i layer and an n+ layer) of each transistor and source and drain electrodes that are in contact with the n+ layer, although not illustrated. Furthermore, the active matrix substrate 3 has an inorganic interlayer insulating film 25 formed in such a way as to cover a metal layer containing each data signal line and an inorganic interlayer insulating film 26 formed on the inorganic interlayer insulating film 25, the inorganic interlayer insulating film 26 being thicker than the inorganic interlayer insulating film 25.

Formed on the inorganic interlayer insulating film 26 are the pixel electrodes 17*a* and 17A, which are covered by an alignment film 9. In the part where the contact hole 11*a* is formed, the inorganic interlayer insulating film 25 and the organic interlayer insulating film 26 are bored through, so that the pixel electrode 17*a* and the capacitor electrode 37*a* are in contact with each other. Further, the retention capacitance Cha (see FIGS. 1 and 2) is formed in a portion where the retention capacitor wire 18*a* and the capacitor electrode 37*a* overlap each other via the gate insulating film 43. Furthermore, the capacitance CaP (see FIGS. 1 and 2) is formed in a portion where the data signal line 15P and the pixel electrode 17*a* overlap each other via the inorganic interlayer insulating film 25 and the organic interlayer insulating film 26, with the parasitic capacitances Csd_aq (see FIG. 2) formed in a portion where the data signal line 15*q* and the pixel electrode 17*a* overlap each other via the inorganic interlayer insulating film 25 and the organic interlayer insulating film 26, with the capacitance Car (see FIGS. 1 and 2) formed in a portion where the data signal line 15*r* and the pixel electrode 17*a* overlap each other via the inorganic interlayer insulating film 25 and the organic interlayer insulating film 26, and with the parasitic capacitances Csd_aQ (see FIG. 2) formed in a portion where the data signal line 15Q and the pixel electrode 17*a* overlap each other via the inorganic interlayer insulating film 25 and the organic interlayer insulating film 26.

Meanwhile, the color filter substrate 4 has a glass substrate 41 on which a black matrix 13 and a colored layer (color filter layer) 14 have been formed, with a common electrode (com) 28 formed on the black matrix 13 and the color filter layer 14 and covered with an alignment film 19.

The foregoing has described a configuration in which data signals are simultaneously written to pixel electrodes respectively contained in two pixels adjacent to each other in the column-wise direction. However, the present invention is not to be limited to such a configuration. A configuration may be such that writing to each pixel electrode is carried out by sequentially (one by one) selecting scanning signal lines corresponding to each separate pixel.

(Method for Fabricating a Liquid Crystal Panel)

Next, a method for fabricating a liquid crystal panel of the present invention is described. The method for fabricating a liquid crystal panel includes an active-matrix substrate fabricating step, a color filter substrate fabricating step, and an assembling step of joining the substrates on top of each other and filling a space between the substrates with liquid crystals.

First, a metal film made of titanium, chromium, aluminum, molybdenum, tantalum, tungsten, copper, or the like, an alloy film made of an alloy thereof, or a laminate film (1000 Å to 3000 Å thick) obtained by joining such films on top of each other is formed by sputtering on a substrate made of glass, plastic, or the like. After that, patterning is carried out by a photolithographic technique (photo engraving process, hereinafter referred to as "PEP technique", which includes an etching step), so that scanning signal lines (gate electrode of each transistor) and retention capacitor wires are formed.

Next, an inorganic insulating film (approximately 3000 Å to 5000 Å thick) of silicon nitride, silicon oxide, or the like is formed by CVD (chemical vapor deposition) over the entire substrate on which the scanning signal lines have been formed, and the photoresist is removed, so that a gate insulating film is formed.

Then, an intrinsic amorphous silicon film (1000 Å to 3000 Å thick) and an n+ amorphous silicon film (approximately 400 Å to 700 Å thick) doped with phosphor are continuously formed by CVD over the gate insulating film (entire substrate). After that, patterning is carried out by the PEP technique, and the photoresist is removed, so that a silicon laminate constituted by the intrinsic amorphous silicon layer and the n+ amorphous silicon layer is formed in the form of an island on the gate electrode.

Then, a metal film made of titanium, chromium, aluminum, molybdenum, tantalum, tungsten, copper, or the like, an alloy film made of an alloy thereof, or a laminate film (1000 Å to 3000 Å thick) obtained by joining such films on top of each other is formed by sputtering over the entire substrate on which the silicon laminate has been formed. After that, patterning is carried out by the PEP technique, so that data signal lines, the source and drain electrodes of transistors, drain drawing electrodes, capacitor electrodes, and drawing wires are formed (formation of a metal layer). The resist is removed as needed here.

Furthermore, by using, as a mask, the photoresist used in formed the metal wires or the source and drain electrodes, the n+ amorphous silicon layer constituting the silicon laminate is etched away, and the photoresist is removed, so that channels in the transistors are formed. It should be noted here that the semiconductor layer may be formed by an amorphous silicon film as described above, but a polysilicon film may also be formed. Further, improvements in crystallinity can be made by performing a laser anneal process on the amorphous silicon film and the polysilicon film. This makes it possible to improve the characteristics of each transistor (TFT) with an increase in speed at which electrons move within the semiconductor layer.

Next, an interlayer insulating film is formed over the entire substrate on which the data signal lines and the like have been formed. Specifically, with use of a mixed gas of $SiH_4$ gas and $NH_3$ gas, an inorganic interlayer insulating film (passivation film) made of SiNx approximately 300 Å thick is formed by CVD in such a way as to cover the entire surface of the substrate, and furthermore, an organic interlayer insulting film made of a positive photosensitive acrylic resin approximately 3 μm thick is formed by spin coating or die coating.

After that, the organic interlayer insulating film is patterned with contact holes by the PEP techniques, and then sintered. Furthermore, by using the pattern on the organic interlayer insulating film, the inorganic interlayer insulating film or the inorganic interlayer insulating film and the gate insulating film is/are etched away, so that the contact holes are formed.

Then, a transparent conductive film (1000 Å to 2000 Å thick) made of ITO (indium tin oxide), IZO (indium zinc oxide), zinc oxide, tin oxide, or the like is formed by sputtering on the interlayer insulating film over the entire substrate in which the contact holes have been formed. After that, patterning is carried out by the PEP technique, and the resist is removed, so that each pixel electrode is formed.

Finally, a polyimide resin 500 Å to 1000 Å thick is printed on the pixel electrodes over the entire substrate. After that, the polyimide resin is calcined, and rubbed with rotating cloth in one direction, so that an alignment film is formed. This is how the active-matrix substrate is fabricated.

The following describes the color filter substrate fabricating step.

First, a black matrix is formed by forming a chromium thin film or a film of resin containing a black pigment on a substrate (entire substrate) made of glass, plastic, or the like and patterning the film by the PEP technique. Next, a red, green, and blue color filter layer (approximately 2 μm thick) is pattern-formed in spaces in the black matrix by using a pigment dispersion method.

Then, a common electrode (com) is formed by forming a transparent conductive film (approximately 1000 Å thick)

made of ITO, IZO, zinc oxide, tin oxide, or the like on the color filter layer over the entire substrate.

Finally, a polyimide resin 500 Å to 1000 Å thick is printed on the common electrode over the entire substrate. After that, the polyimide resin is calcined, and rubbed with rotating cloth in one direction, so that an alignment film is formed. This is how the color filter substrate is fabricated.

The following describes the assembling step.

First, a sealing material made of a thermosetting epoxy resin is applied by screen printing onto either the active-matrix substrate and the color filter substrate into a frame pattern lacking a part that serves as a liquid crystal inlet later, and spherical spacers each having a diameter equivalent to the thickness of the liquid crystal layer and made of plastic or silica are scattered on the other substrate. It is possible to form spacers on the black matrix of the color filter substrate or on the metal wires of the active-matrix substrate by the PEP technique instead of scattering spacers.

Next, the active-matrix substrate and the color filter substrate are joined on top of each other, and the sealing material is cured.

Finally, the liquid crystal layer is formed by filling the space enclosed by the active-matrix substrate, the color filter, and the sealing material with a liquid crystal material by an evacuation method, applying a UV-curing resin to the liquid crystal inlet, and then sealing the liquid crystal material by UV irradiation. This is how the liquid crystal panel is fabricated.

It should be noted here that the liquid crystal panel 10 shown in FIG. 1 may be configured in any one of the following manners. The following describes other configurations of the liquid crystal panel according to the present invention. For convenience of explanation, a description of components identical to those of the aforementioned liquid crystal panel is omitted as needed.

(Example Configuration 2 of a Liquid Crystal Panel)

Figure 7:
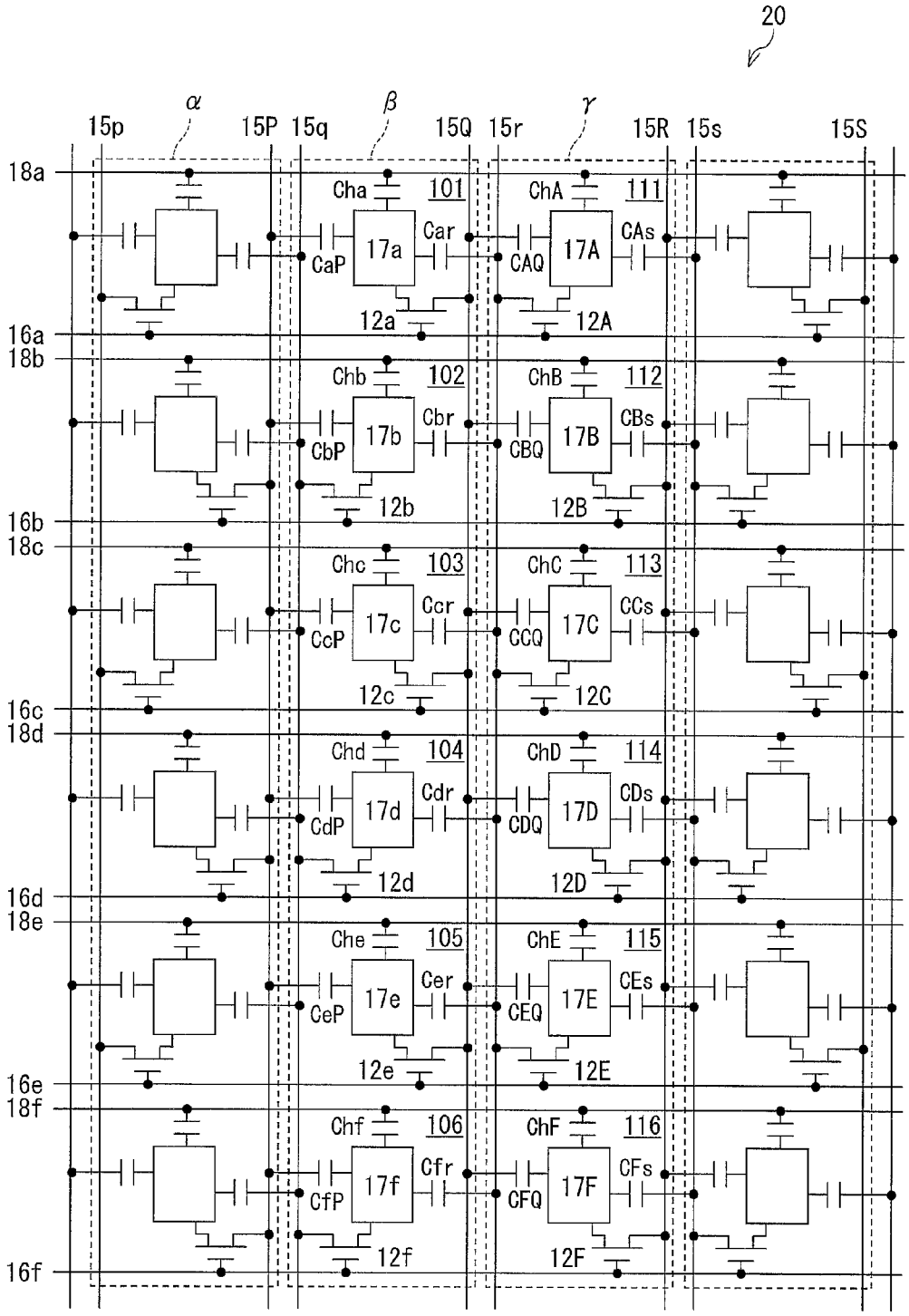
FIG. 7 is an equivalent circuit diagram showing part of a configuration of a liquid crystal panel in Example Configuration 2.

FIG. 7 is an equivalent circuit diagram showing part of a configuration of a liquid crystal panel 20 in Example Configuration 2. The arrangement of the data signal lines, the scanning signal lines, the retention capacitor wires, and the pixels of the liquid crystal panel 20 of FIG. 7 is identical to that of the liquid crystal panel 10 of FIG. 1.

In the present liquid crystal panel 20, each pixel is provided with a pixel electrode. The pixel 101 has its pixel electrode 17*a* connected to the data signal line 15Q via a transistor 12*a* connected to the scanning signal line 16*a*. The pixel 102 has its pixel electrode 17*b* connected to the data signal line 15*q* via a transistor 12*b* connected to the scanning signal line 16*b*. The pixel 103 has its pixel electrode 17*c* connected to the data signal line 15Q via a transistor 12*c* connected to the scanning signal line 16*c*. The pixel 104 has its pixel electrode 17*d* connected to the data signal line 15*q* via a transistor 12*d* connected to the scanning signal line 16*d*. The pixel 105 has its pixel electrode 17*e* connected to the data signal line 15Q via a transistor 12*e* connected to the scanning signal line 16*e*. The pixel 106 has its pixel electrode 17*f* connected to the data signal line 15*q* via a transistor 12*f* connected to the scanning signal line 16*f*.

Meanwhile, the pixel 111 has its pixel electrode 17A connected to the data signal line 15*r* via a transistor 12A connected to the scanning signal line 16*a*. The pixel 112 has its pixel electrode 17B connected to the data signal line 15R via a transistor 12B connected to the scanning signal line 16*b*. The pixel 113 has its pixel electrode 17C connected to the data signal line 15*r* via a transistor 12C connected to the scanning signal line 16*c*. The pixel 114 has its pixel electrode 17D connected to the data signal line 15R via a transistor 12D connected to the scanning signal line 16*d*. The pixel 115 has its pixel electrode 17E connected to the data signal line 15*r* via a transistor 12E connected to the scanning signal line 16*e*. The pixel 116 has its pixel electrode 17F connected to the data signal line 15R via a transistor 12F connected to the scanning signal line 16*f*.

That is, unlike in the case of the configuration of the liquid crystal panel 10 of FIG. 1, the data signal line 15Q, connected to the respective pixel electrodes (17*a*, 17*c*, 17*e*) of the odd-numbered pixels (101, 103, 105) of the column of pixels β, and the data signal line 15*r*, connected to the respective pixel electrodes (17A, 17C, 17E) of the odd-numbered pixels (111, 113, 115) of the column of pixels γ, are adjacent to each other.

Figure 8:
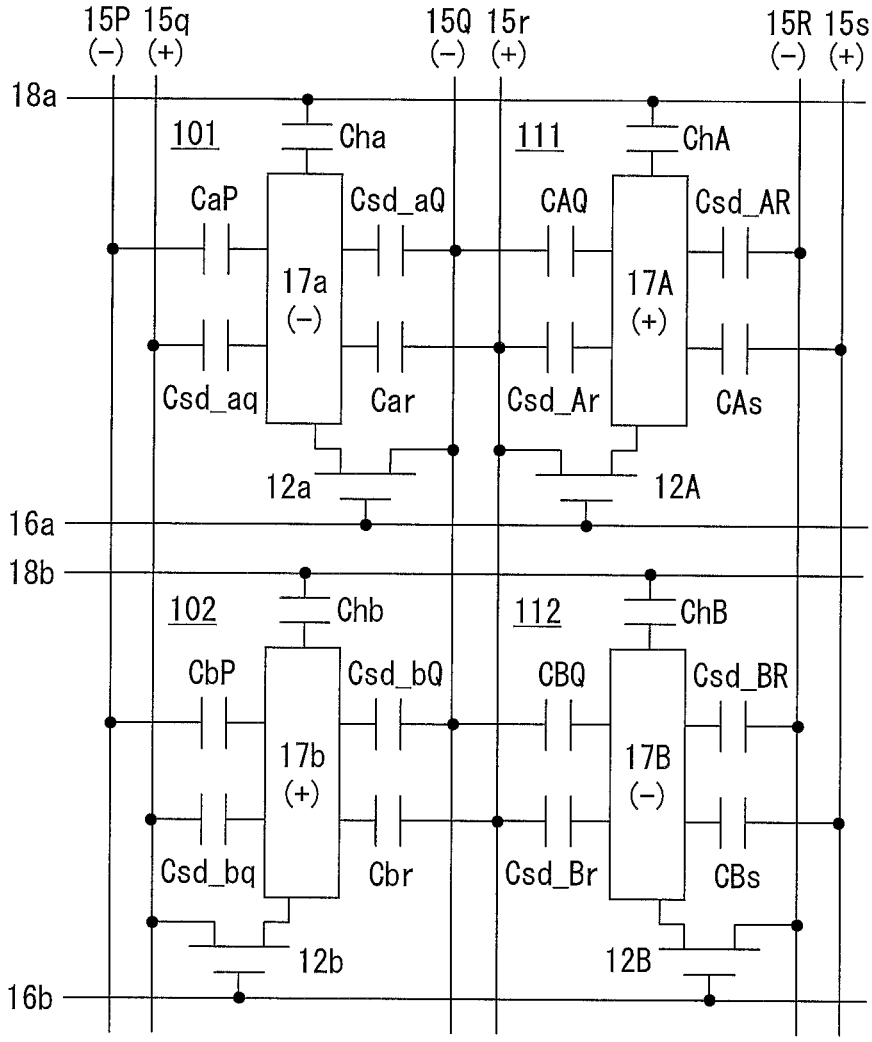
FIG. 8 is an equivalent circuit diagram showing the appearance of capacitances formed in pixels 101, 102, 103, 111, 112, and 113 of the liquid crystal panel of FIG. 7.

FIG. 8 is an equivalent circuit diagram showing the appearance of the capacitances formed in the pixels 101, 102, 111, and 112 of the liquid crystal panel 20 shown in FIG. 7. As in FIG. 2, for example, the pixel electrode 17*b* forms parasitic capacitances Csd_bq and Csd_bQ with the data signal lines 15*q* and 15Q corresponding to the pixel 102, respectively, and forms the capacitances CbP and Cbr with the data signal lines 15P and 15*r* corresponding to both adjacent columns of pixels α and γ, respectively.

Figure 9:
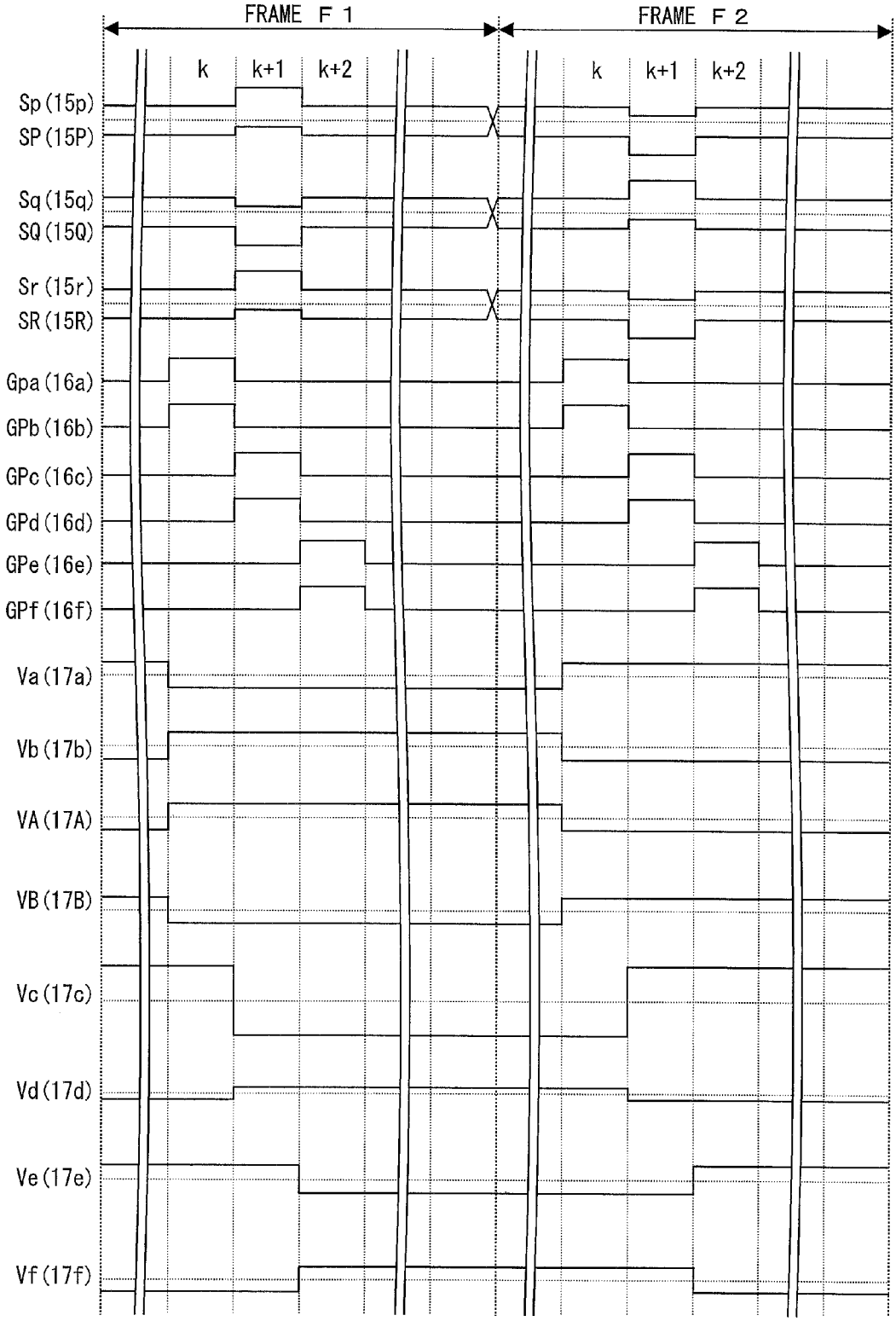
FIG. 9 is a timing chart showing a method for driving the liquid crystal panel of FIG. 7.

FIG. 9 is a timing chart showing a method (normally black mode) for driving the liquid crystal panel 20 of FIG. 7.

According to the present driving method, as shown in FIG. 9, two scanning signals are simultaneously selected at a time and each data signal line is supplied with a data signal whose polarity is reversed every single frame period, and during the same horizontal scanning period, two data signal lines (15*p* and 15P, 15*q* and 15Q, 15*r* and 15R) corresponding to the same column of pixels are supplied with data signals of opposite polarities while two adjacent data signal lines (15P and 15*q*, 15Q and 15*r*, 15R and 15*s*) are supplied with data signals of opposite polarities. That is, a comparison with the driving method of FIG. 3 shows that the data signals Sq and SQ have been interchanged.

This causes the pixel potentials (Va, Vb, VA, VB, Vc, Vd, Ve, Vf) to change in the same way as the pixel potentials shown in FIG. 3.

Figure 10:
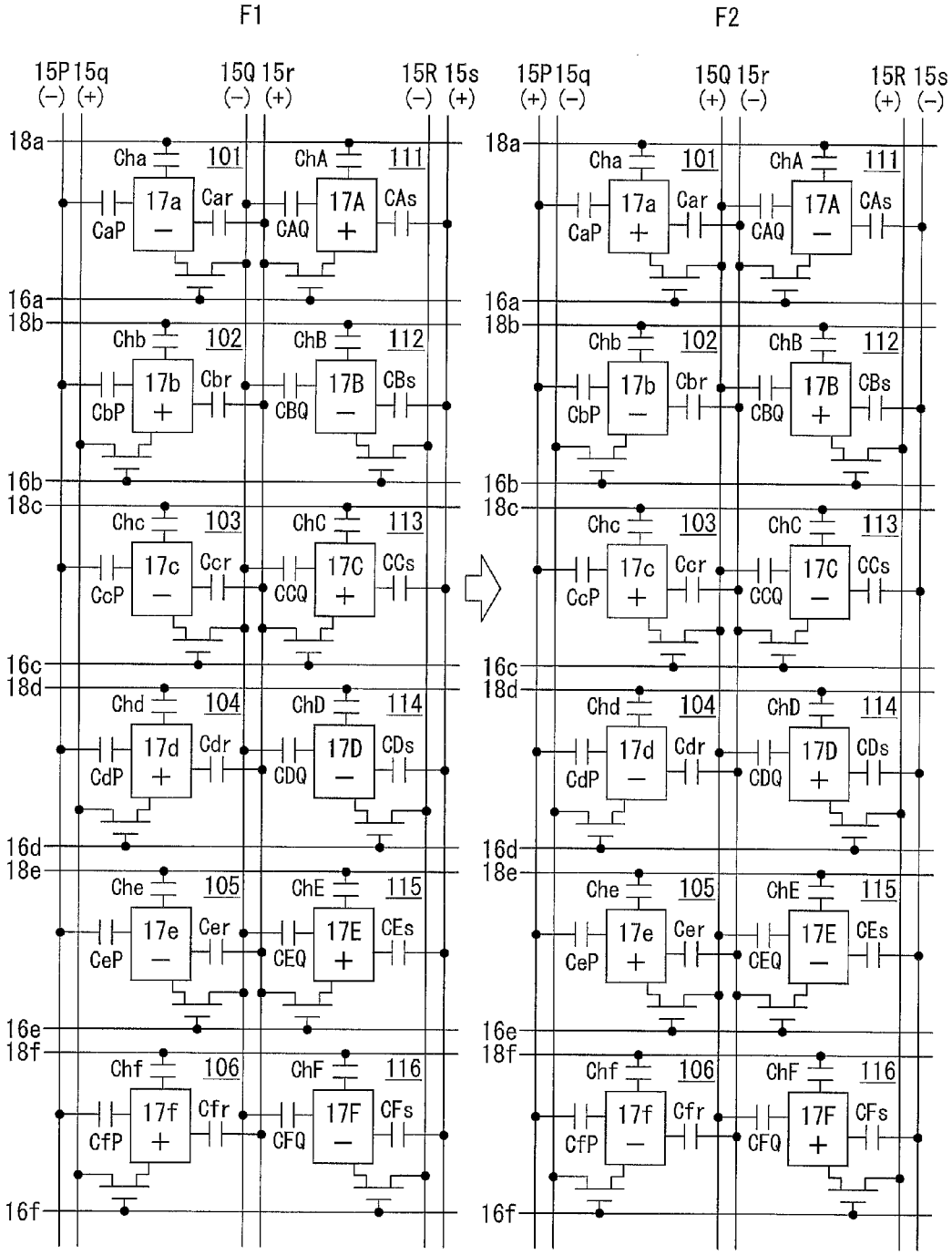
FIG. 10 is a schematic view showing a display state of the liquid crystal panel by the driving method of FIG. 9.

Thus, in the frame F1, as shown in FIG. 10, a data signal of a negative polarity, a data signal of a positive polarity, a data signal of a negative polarity, a data signal of a positive polarity, a data signal of a negative polarity, and a data signal of a positive polarity are written to the pixel electrode 17*a* of the pixel 101, the pixel electrode 17*b* of the pixel 102, the pixel electrode 17*c* of the pixel 103, the pixel electrode 17*d* of the pixel 104, the pixel electrode 17*e* of the pixel 105, and the pixel electrode 17*f* of the pixel 106, respectively. Similarly, a data signal of a positive polarity, a data signal of a negative polarity, a data signal of a positive polarity, a data signal of a negative polarity, a data signal of a positive polarity, and a data signal of a negative polarity are written to the pixel electrode 17A of the pixel 111, the pixel electrode 17B of the pixel 112, the pixel electrode 17C of the pixel 113, the pixel electrode 17D of the pixel 114, the pixel electrode 17E of the pixel 115, and the pixel electrode 17F of the pixel 116, respectively.

Further, in the frame F2, as shown in FIG. 10, a data signal of a positive polarity, a data signal of a negative polarity, a data signal of a positive polarity, a data signal of a negative polarity, a data signal of a positive polarity, and a data signal of a negative polarity are written to the pixel electrode 17*a* of the pixel 101, the pixel electrode 17*b* of the pixel 102, the pixel electrode 17*c* of the pixel 103, the pixel electrode 17*d* of the pixel 104, the pixel electrode 17*e* of the pixel 105, and the pixel electrode 17*f* of the pixel 106, respectively. Similarly, a data signal of a negative polarity, a data signal of a positive polarity, a data signal of a negative polarity, a data signal of a positive polarity, a data signal of a negative polarity, and a data signal of a positive polarity are written to the pixel electrode 17A of the pixel 111, the pixel electrode 17B of the pixel 112, the pixel electrode 17C of the pixel 113, the pixel electrode 17D of the pixel 114, the pixel electrode 17E of the pixel 115, and the pixel electrode 17F of the pixel 116, respectively. The present driving method achieves dot-reversal driving.

In the present configuration, the data signal line 15*q* is supplied with a data signal of a positive polarity corresponding to gray during the kth horizontal scanning period, is supplied with a data signal of a positive polarity corresponding to black during the (k+1)th horizontal scanning period, and is supplied with a data signal of a positive polarity corresponding to gray during the (k+2)th horizontal scanning period. Meanwhile, the data signal line 15Q is supplied with a data signal of a negative polarity corresponding to gray during the kth horizontal scanning period, is supplied with a data signal of a negative polarity corresponding to white during the (k+1)th horizontal scanning period, and is supplied with a data signal of a negative polarity corresponding to gray during the (k+2)th horizontal scanning period. That is, at the transition from the kth horizontal scanning period to the (k+1)th horizontal scanning period, the potentials of the data signals that are supplied to the data signal lines 15*q* and 15Q change in a falling direction (negative direction), and at the transition from the (k+1)th horizontal scanning period to the (k+2)th horizontal scanning period, the potentials of the data signals that are supplied to the data signal lines 15*q* and 15Q change in a rising direction (positive direction).

For this reason, in the pixel electrode 17*a*, the pixel potential Va (data signal of a negative polarity corresponding to gray) written during the kth horizontal scanning period changes in a falling direction (negative direction) in the (k+1)th horizontal scanning period due to the parasitic capacitances Csd_aq and Csd_aQ between the pixel electrode 17*a* and the data signal lines 15*q* and 15Q, respectively, and changes in a rising direction (positive direction) in the (k+2)th horizontal scanning period due to the parasitic capacitances Csd_aq and Csd_aQ between the pixel electrode 17*a* and the data signal lines 15*q* and 15Q, respectively (see FIG. 34).

In the present configuration, however, the pixel electrode 17*a* forms capacitances CaP and Car with the data signal lines 15P and 15*r*, respectively. The data signal line 15P is supplied with a data signal of a negative polarity corresponding to gray during the kth horizontal scanning period, is supplied with a data signal of a negative polarity corresponding to black during the (k+1)th horizontal scanning period, and is supplied with a data signal of a negative polarity corresponding to gray during the (k+2)th horizontal scanning period. The data signal line 15*r* is supplied with a data signal of a positive polarity corresponding to gray during the kth horizontal scanning period, is supplied with a data signal of a positive polarity corresponding to white during the (k+1)th horizontal scanning period, and is supplied with a data signal of a positive polarity corresponding to gray during the (k+2)th horizontal scanning period.

For this reason, in the pixel electrode 17*a*, the pixel potential Va (data signal of a negative polarity corresponding to gray) written during the kth horizontal scanning period changes in a rising direction (positive direction) in the (k+1)th horizontal scanning period due to the capacitances CaP and Car, respectively, and changes in a falling direction (negative direction) in the (k+2)th horizontal scanning period due to the capacitances CaP and Car. This makes it possible to curb the influence of a crosstalk and thus enhance display quality, as in Example Configuration 1.

Figure 11:
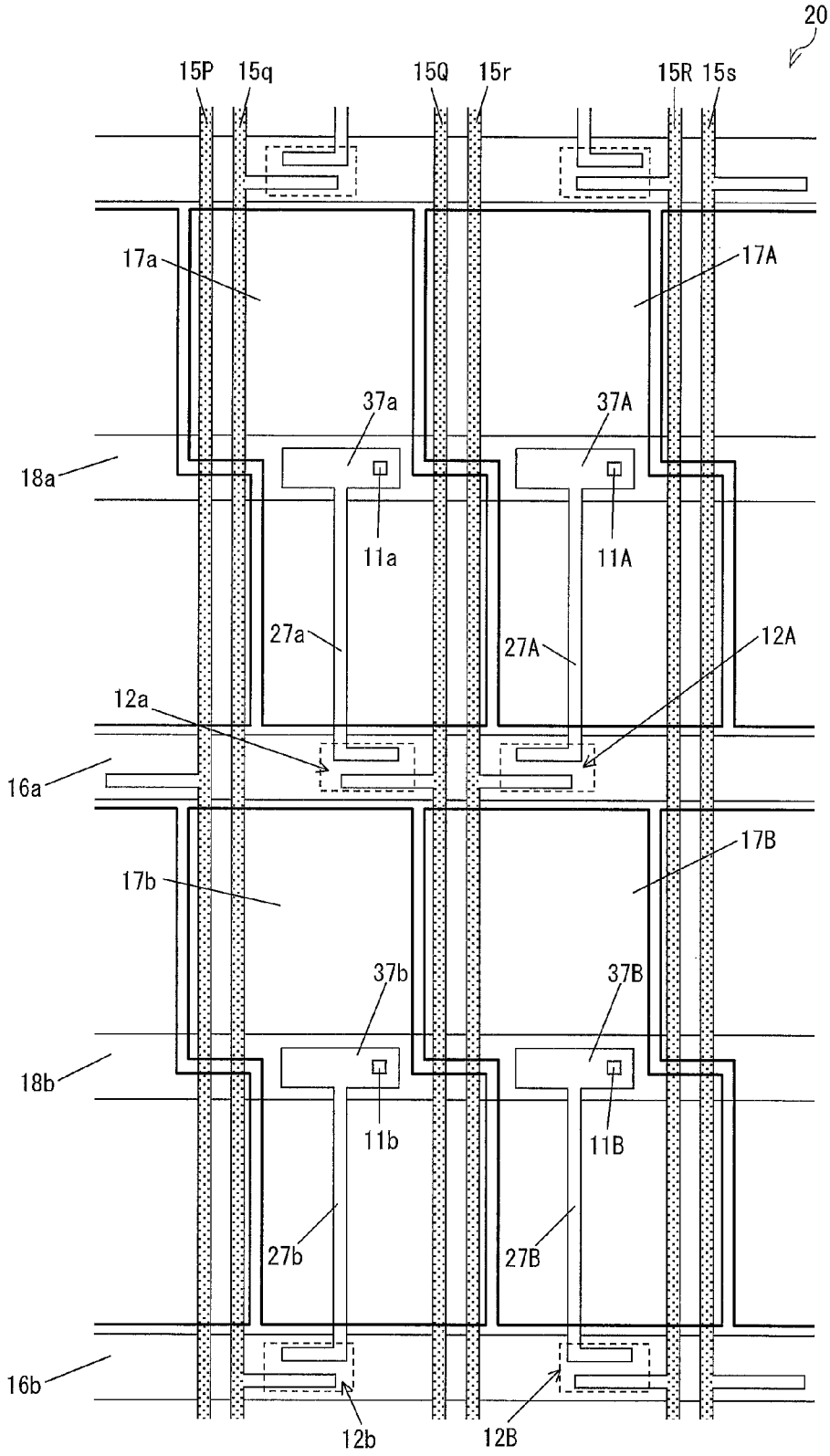
FIG. 11 is a plan view showing a configuration of the liquid crystal panel of FIG. 7.

FIG. 11 is a plan view showing Example Configuration 2 of the liquid crystal panel 20 of FIG. 7. The present liquid crystal panel 20 has its transistor 12*a* provided near an intersection between the data signal line 15Q and the scanning signal line 16*a*, has its transistor 12*b* provided near an intersection between the data signal line 15*q* and the scanning signal line 16*b*, has its transistor 12A provided near an intersection between the data signal line 15*r* and the scanning signal line 16*a*, and has its transistor 12B provided near an intersection between the data signal line 15R and the scanning signal line 16*b*. The other components of the liquid crystal panel 20 of FIG. 7 are identical to those of the liquid crystal panel 10 of FIG. 5.

(Example Configuration 3 of a Liquid Crystal Panel)

Figure 12:
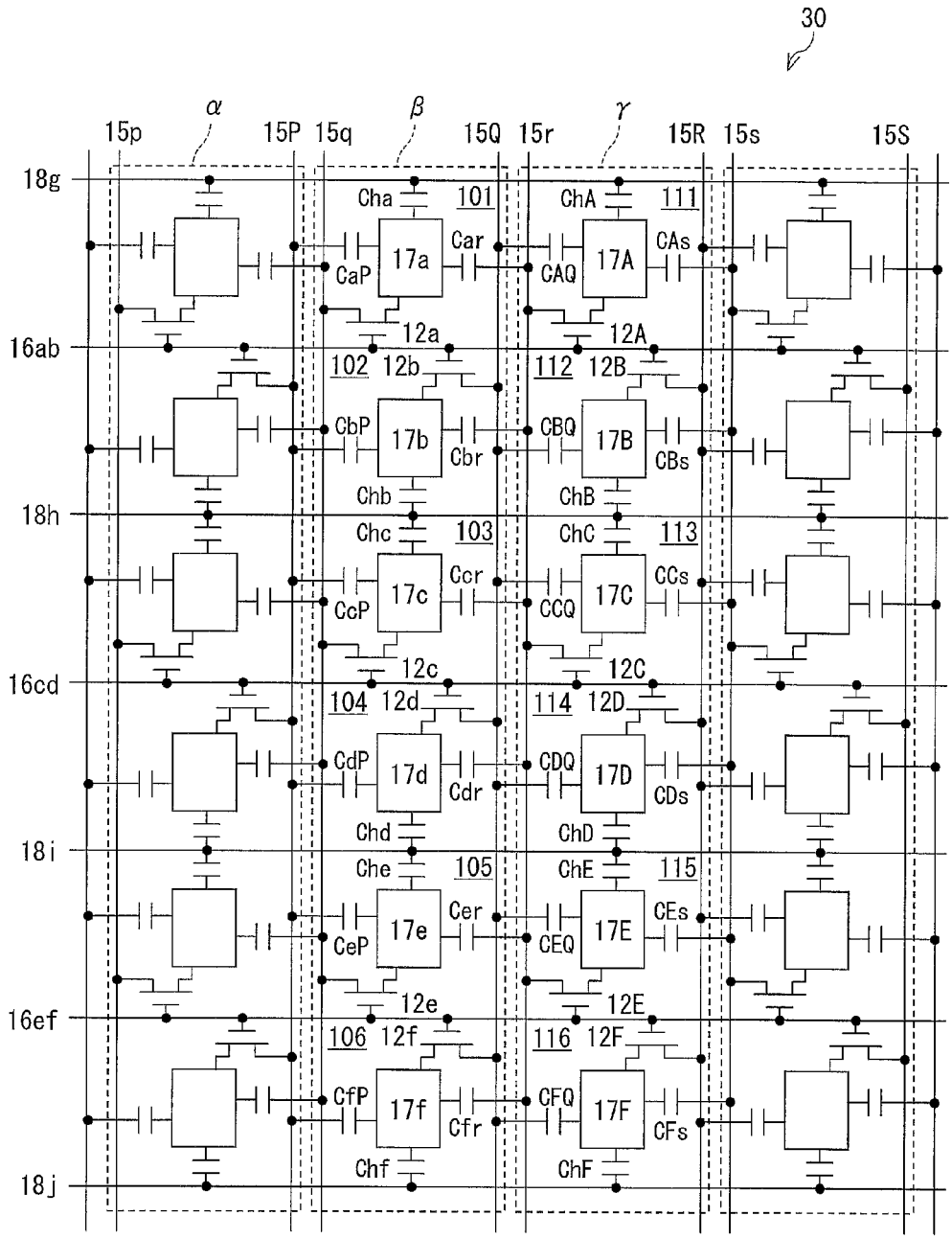
FIG. 12 is an equivalent circuit diagram showing part of a configuration of a liquid crystal panel in Example Configuration 3.

FIG. 12 is an equivalent circuit diagram showing part of a configuration of a liquid crystal panel 30 in Example Configuration 3. The liquid crystal panel 30 of FIG. 12 has data signal lines 15P, 15*q*, 15Q, 15*r*, 15R, and 15*s* arranged in this order, and has scanning signal lines 16*ab*, 16*cd*, and 16*ef* extending in the row-wise direction (in the drawing, a horizontal direction) and arranged in this order. The liquid crystal panel 30 has pixels 101 and 102 provided at intersections between the data signal lines 15*q* and 15Q and the scanning signal line 16*ab*, pixels 103 and 104 provided at intersections between the data signal lines 15*q* and 15Q and the scanning signal line 16*cd*, and pixels 105 and 106 provided at intersections between the data signal lines 15*q* and 15Q and the scanning signal line 16*ef*. Similarly, the liquid crystal panel 30 has pixels 111 and 112 provided at intersections between the data signal lines 15*r* and 15R and the scanning signal line 16*ab*, pixels 113 and 114 provided at intersections between the data signal lines 15*r* and 15R and the scanning signal line 16*cd*, and pixels 115 and 116 provided at intersections between the data signal lines 15*r* and 15R and the scanning signal line 16*ef*.

Further, the liquid crystal panel 30 has a retention capacitor wire 18*g* provided for the pixels 101 and 111, a retention capacitor wire 18*h* provided for the pixels 102, 112, 103, and 113, a retention capacitor wire 18*i* provided for the pixels 104, 114, 105, and 115, a retention capacitor wire 18*j* provided for the pixels 106 and 116.

The liquid crystal panel 30 has a retention capacitance Cha formed between the retention capacitor wire 18*g* and the pixel electrode 17*a*, a retention capacitance Chb formed between the retention capacitor wire 18*h* and the pixel electrode 17*b*, a retention capacitance Chc formed between the retention capacitor wire 18*h* and the pixel electrode 17*c*, a retention capacitance Chd formed between the retention capacitor wire 18*i* and the pixel electrode 17*d*, a retention capacitance Che formed between the retention capacitor wire 18*i* and the pixel electrode 17*e*, and a retention capacitance Chf formed between the retention capacitor wire 18*j* and the pixel electrode 17*f*. Similarly, the liquid crystal panel 30 has a retention capacitance ChA formed between the retention capacitor wire 18*g* and the pixel electrode 17A, a retention capacitance ChB formed between the retention capacitor wire 18*h* and the pixel electrode 17B, a retention capacitance ChC formed between the retention capacitor wire 18*h* and the pixel electrode 17C, a retention capacitance ChD formed between the retention capacitor wire 18*i* and the pixel electrode 17D, a retention capacitance ChE formed between the retention capacitor wire 18*i* and the pixel electrode 17E, and a retention capacitance ChF formed between the retention capacitor wire 18*j* and the pixel electrode 17F.

Figure 13:
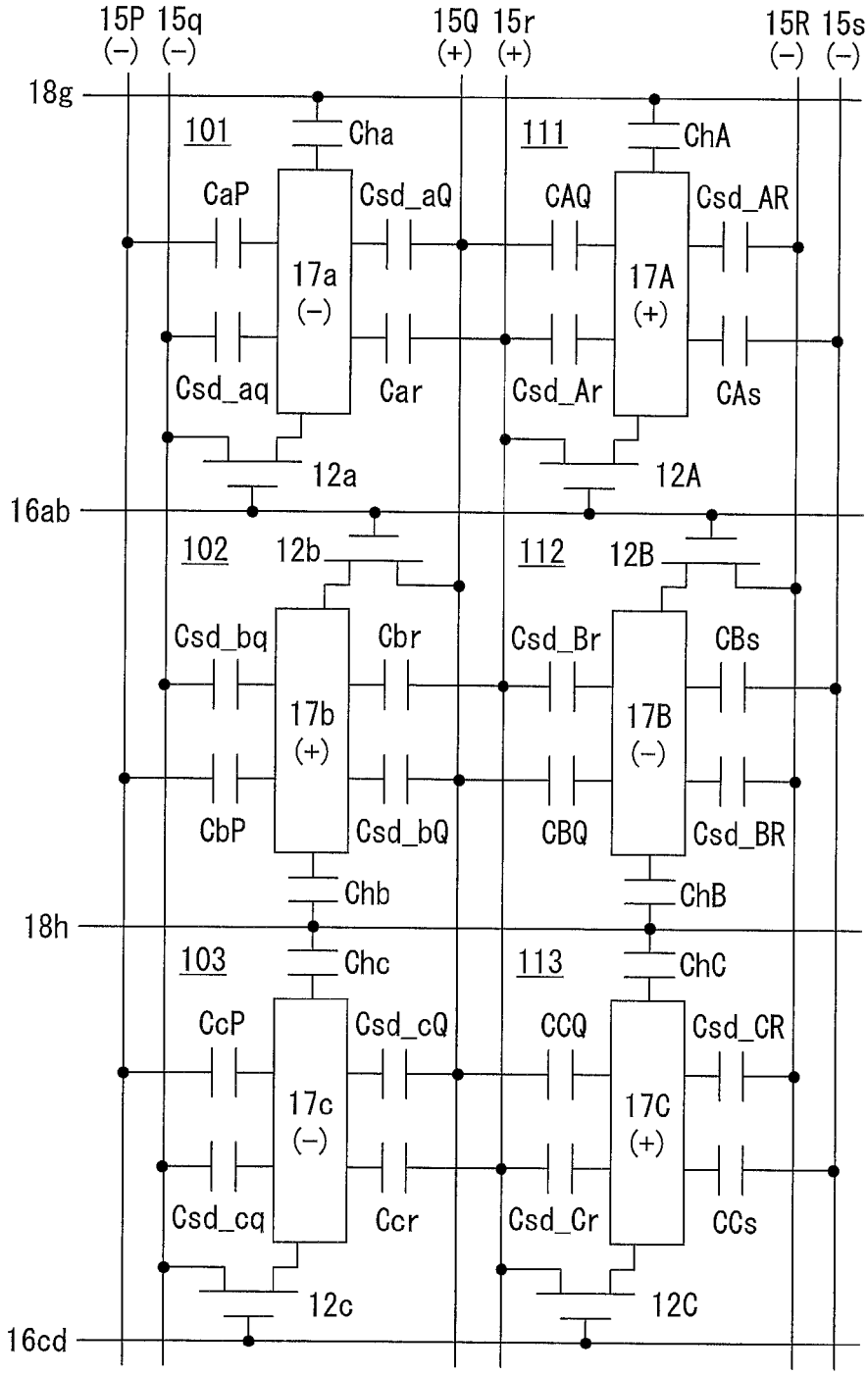
FIG. 13 is an equivalent circuit diagram showing the appearance of capacitances formed in pixels 101, 102, 111, and 112 of the liquid crystal panel of FIG. 12.

FIG. 13 is an equivalent circuit diagram showing the appearance of the capacitances formed in the pixels 101, 102, 103, 111, 112, and 113 of the liquid crystal panel 30 of FIG. 12. As in FIG. 2, for example, the pixel electrode 17*b* forms parasitic capacitances Csd_bq and Csd_bQ with the data signal lines 15*q* and 15Q corresponding to the pixel 102, respectively, and forms the capacitances CbP and Cbr with the data signal lines 15P and 15*r* corresponding to both adjacent columns of pixels α and γ, respectively.

Figure 14:
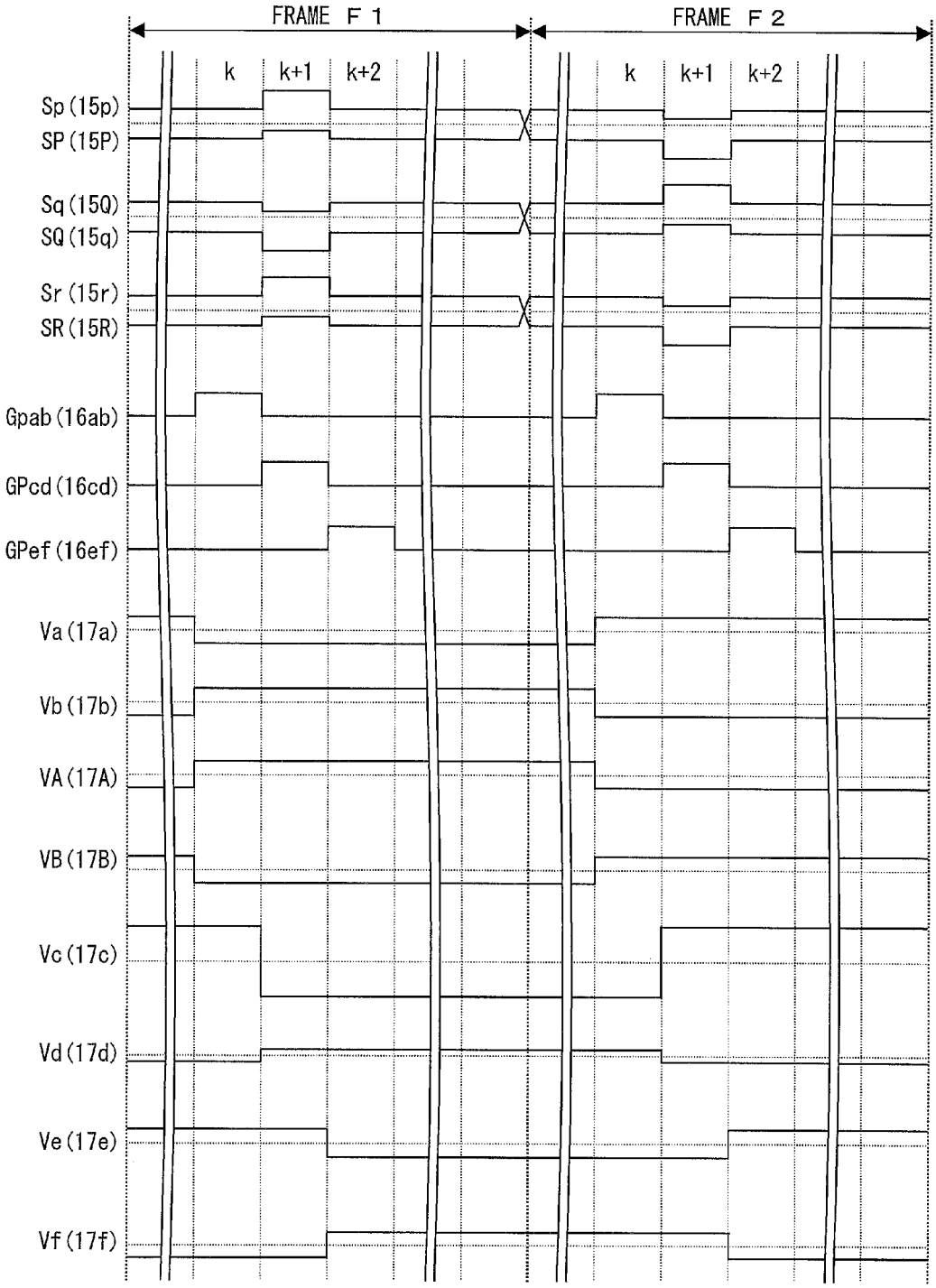
FIG. 14 is a timing chart showing a method for driving the liquid crystal panel of FIG. 12.

FIG. 14 is a timing chart showing a method (normally black mode) for driving the liquid crystal panel 30 of FIG. 12. It should be noted that the reference sings GPab, GPcd, and GPef refer to data signals that are supplied to the scanning signal lines 16*ab*, 16*cd*, and 16*ef*, respectively.

According to the present driving method, as shown in FIG. 14, one scanning signal is selected at a time and each data signal line is supplied with a data signal whose polarity is reversed every single frame period, and during the same horizontal scanning period, two data signal lines (15*p* and 15P, 15*q* and 15Q, 15*r* and 15R) corresponding to the same column of pixels are supplied with data signals of opposite polarities while two adjacent data signal lines (15P and 15*q*, 15Q and 15*r*, 15R and 15*s*) are supplied with data signals of the same polarity. Changes in each separate pixel electrode are identical to those shown in the timing chart of FIG. 3, and as such, are not described here.

Figure 15:
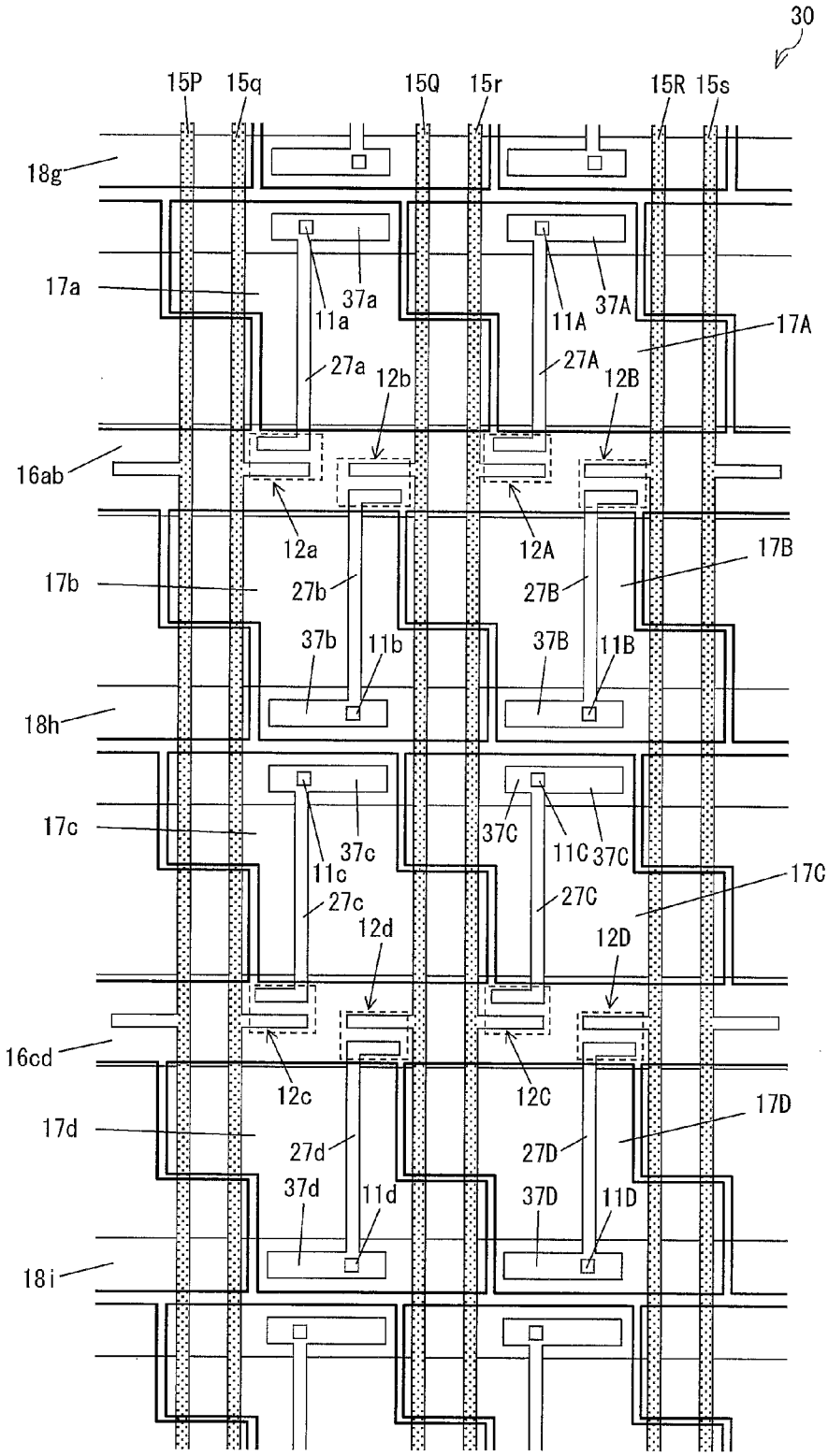
FIG. 15 is a plan view showing a configuration of the liquid crystal panel of FIG. 12.

FIG. 15 is a plan view showing Example Configuration 3 of the liquid crystal panel 30 of FIG. 12.

As shown in FIG. 15, the present liquid crystal panel 30 has a pair of (two) data signal lines 15*q* and 15Q and a pair of (two) data signal lines 15*r* and 15R provided so that the data signal line 15Q and the data signal line 15*r* are adjacent to each other, and has its scanning signal lines 16*ab* and 16*cd* provided in such a way as to be orthogonal to the data signal lines. Moreover, the present liquid crystal panel 30 has its transistor 12*a* provided near an intersection between the data signal line 15*q* and the scanning signal line 16*ab*, has its transistor 12*b* provided near an intersection between the data signal line 15Q and the scanning signal line 16*ab*, has its transistor 12A provided near an intersection between the data signal line 15*r* and the scanning signal line 16*ab*, and has its transistor 12B provided near an intersection between the data signal line 15R and the scanning signal line 16*ab*. Further, the present liquid crystal panel 30 has its transistor 12*c* provided near an intersection between the data signal line 15*q* and the scanning signal line 16*cd*, has its transistor 12*d* provided near an intersection between the data signal line 15Q and the scanning signal line 16*cd*, has its transistor 12C provided near an intersection between the data signal line 15*r* and the scanning signal line 16*cd*, and has its transistor 12D provided near an intersection between the data signal line 15R and the scanning signal line 16*cd*.

The present liquid crystal panel 30 has its pixel electrodes 17*a*, 17*b*, 17*c*, and 17*d* provided so that parts thereof overlap the data signal lines 15P, 15*q*, 15Q, and 15*r*, respectively, and has its pixel electrodes 17A, 17B, 17C, and 17D provided so that parts thereof overlap the data signal lines 15Q, 15*r*, 15R, and 15*s*, respectively.

Further, the present liquid crystal panel 30 has its retention capacitor wire 18*g* provided in such a way as to overlap the pixel electrodes 17*a* and 17A, has its retention capacitor wire 18*h* provided in such a way as to overlap the pixel electrodes 17*b*, 17B, 17*c*, and 17C, and has its retention capacitor wire 18*i* provided in such a way as to overlap the pixel electrodes 17*d* and 17D.

Moreover, the scanning signal line 16*ab* functions as the gate electrode of the transistor 12*a*, which has its source electrode connected to the data signal line 15*q* and which has its drain electrode connected to a capacitor electrode 37*a* via a drain drawing electrode 27*a*. The capacitor electrode 37*a* is provided above the retention capacitor wire 18*g* and is connected to the pixel electrode 17*a* via a contact hole 11*a*. Further, the scanning signal line 16*ab* functions as the gate electrode of the transistor 12*b*, which has its source electrode connected to the data signal line 15Q and which has its drain electrode connected to a capacitor electrode 37*b* via a drain drawing electrode 27*b*. The capacitor electrode 37*b* is provided above the retention capacitor wire 18*h* and is connected to the pixel electrode 17*b* via a contact hole 11*b*.

Similarly, the scanning signal line 16*cd* functions as the gate electrode of the transistor 12*c*, which has its source electrode connected to the data signal line 15*q* and which has its drain electrode connected to a capacitor electrode 37*c* via a drain drawing electrode 27*c*. The capacitor electrode 37*c* is provided above the retention capacitor wire 18*h* and is connected to the pixel electrode 17*c* via a contact hole 11*c*. Further, the scanning signal line 16*cd* functions as the gate electrode of the transistor 12*d*, which has its source electrode connected to the data signal line 15Q and which has its drain electrode connected to a capacitor electrode 37*d* via a drain drawing electrode 27*d*. The capacitor electrode 37*d* is provided above the retention capacitor wire 18*i* and is connected to the pixel electrode 17*d* via a contact hole 11*d*. The pixel electrodes 17A, 17B, 17C, and 17D are identical in configuration to the aforementioned pixel electrodes 17*a*, 17*b*, 17*c*, and 17*d*.

The present liquid crystal panel 30 is configured such that the retention capacitance Cha (see FIG. 12) is formed in a portion where the retention capacitor wire 18*g* and the capacitor electrode 37*a* overlap each other via a gate insulating film, that the retention capacitance Chb (see FIG. 12) is formed in a portion where the retention capacitor wire 18*h* and the capacitor electrode 37*b* overlap each other via the gate insulating film, that the retention capacitance Chc (see FIG. 12) is formed in a portion where the retention capacitor wire 18*h* and the capacitor electrode 37*c* overlap each other via the gate insulating film, and that the retention capacitance Chd (see FIG. 12) is formed in a portion where the retention capacitor wire 18*i* and the capacitor electrode 37*d* overlap each other via the gate insulating film.

The present liquid crystal panel 30 provides each set of two pixels with one scanning signal line and one retention capacitor wire and therefore can reduce the number of scanning signal lines and retention capacitor wires in comparison with the liquid crystal panel 10 shown in FIG. 1. This allows for a higher aperture ratio, thus allowing improved efficiency in the use of light. It should be noted that the number and arrangement of scanning signal lines and retention capacitor wires can be determined as needed according to the purpose for which the liquid crystal panel is used.

(Example Configuration 4 of a Liquid Crystal Panel)

Figure 16:
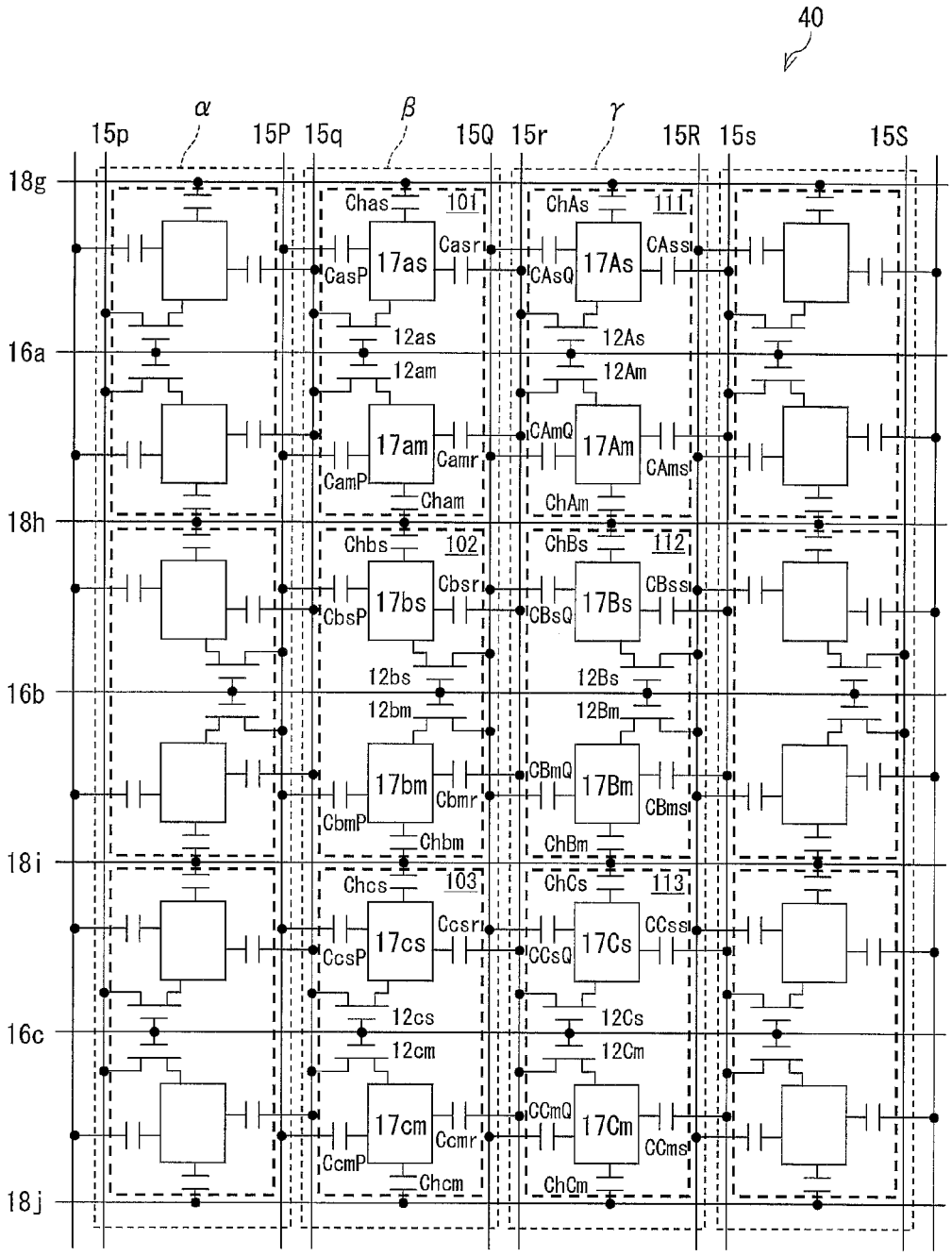
FIG. 16 is an equivalent circuit diagram showing part of a configuration of a liquid crystal panel in Example Configuration 4.

FIG. 16 is an equivalent circuit diagram showing part of a configuration of a liquid crystal panel 40 in Example Configuration 4. In the present liquid crystal panel 40 of FIG. 16, each pixel is provided with two pixel electrodes. The pixel 101 has its pixel electrode 17*am* connected to the data signal line 15*q* via a transistor 12*am* connected to the scanning signal line 16*a*, and has its pixel electrode 17 as connected to the data signal line 15*q* via a transistor 12 as connected to the scanning signal line 16*a*. The pixel 102 has its pixel electrode 17*bm* connected to the data signal line 15Q via a transistor 12*bm* connected to the scanning signal line 16*b*, and has its pixel electrode 17*bs* connected to the data signal line 15Q via a transistor 12*bs* connected to the scanning signal line 16*b*.

The pixel 103 has its pixel electrode 17*cm* connected to the data signal line 15*q* via a transistor 12*cm* connected to the scanning signal line 16*c*, and has its pixel electrode 17*cs* connected to the data signal line 15*q* via a transistor 12*cs* connected to the scanning signal line 16*c*.

Further, the pixel 111 has its pixel electrode 17Am connected to the data signal line 15*r* via a transistor 12Am connected to the scanning signal line 16*a*, and has its pixel electrode 17As connected to the data signal line 15*r* via a transistor 12As connected to the scanning signal line 16*a*. The pixel 112 has its pixel electrode 17Bm connected to the data signal line 15R via a transistor 12Bm connected to the scanning signal line 16*b*, and has its pixel electrode 17Bs connected to the data signal line 15R via a transistor 12Bs connected to the scanning signal line 16*b*. The pixel 113 has its pixel electrode 17Cm connected to the data signal line 15*r* via a transistor 12Cm connected to the scanning signal line 16*c*, and has its pixel electrode 17Vs connected to the data signal line 15*r* via a transistor 12Cs connected to the scanning signal line 16*c*.

The liquid crystal panel 30 has a retention capacitance Chas formed between the retention capacitor wire 18*g* and the pixel electrode 17 as, a retention capacitance Cham formed between the retention capacitor wire 18*h* and the pixel electrode 17*am*, a retention capacitance Chbs formed between the retention capacitor wire 18*h* and the pixel electrode 17*bs*, a retention capacitance Chbm formed between the retention capacitor wire 18*i* and the pixel electrode 17*bm*, a retention capacitance Chcs formed between the retention capacitor wire 18*i* and the pixel electrode 17*cs*, and a retention capacitance Chcm formed between the retention capacitor wire 18*j* and the pixel electrode 1 cm. Similarly, the liquid crystal panel 30 has a retention capacitance ChAs formed between the retention capacitor wire 18*g* and the pixel electrode 17As, a retention capacitance ChAm formed between the retention capacitor wire 18*h* and the pixel electrode 17Am, a retention capacitance ChBs formed between the retention capacitor wire 18*h* and the pixel electrode 17Bs, a retention capacitance ChBm formed between the retention capacitor wire 18*i* and the pixel electrode 17Bm, a retention capacitance ChCs formed between the retention capacitor wire 18*i* and the pixel electrode 17Cs, and a retention capacitance ChCm formed between the retention capacitor wire 18*j* and the pixel electrode 17Cm.

By applying the driving method shown in FIG. 3 to the foregoing configuration, the aforementioned effects can be brought about. Furthermore, in this example configuration, Cs signals that are supplied to the retention capacitor wires are level-shifted, in addition to the driving method shown in FIG. 3. In the pixel 102, for example, a Cs signal that is supplied to the retention capacitor wire 18*i* and a Cs signal that is supplied to the retention capacitor wire 18*h* are level-shifted in opposite directions (rising and falling directions) after the end of scanning of the scanning signal line 16*b*. This makes it possible to cause the potential of either of two subpixels bm and bs respectively containing the pixel electrodes 17*bm* and 17*bs* to become higher than the potential written from the data signal line 15Q and cause the potential of the other subpixel to become lower than the written potential, so that the subpixel bm and bs have different luminances. For example, the Cs signal that is supplied to the retention capacitor wire 18*i* is level-shifted (raised) from "L" to "H" after the end of scanning of the scanning signal line 16*b*, while the Cs signal that is supplied to the retention capacitor wire 18*h* is level-shifted (dropped) from "H" to "L" after the end of scanning of the scanning signal line 16*b*. This makes it possible to cause the potential of the subpixel bm containing the pixel electrode 17*bm* to become higher than the potential written from the data signal line 15Q and cause the potential of the subpixel bs containing the pixel electrode 17*bs* to become lower than the written potential, so that the subpixels bm and bs serve as a bright subpixel and a dark subpixel, respectively, in the case where the written potential is of a positive polarity.

Thus, the present liquid crystal panel 40 can display a halftone by using bright and dark subpixels and can therefore enhance viewing angle characteristics.

(Example Configuration 5 of a Liquid Crystal Panel)

The aforementioned Example Configurations 1 to 4 are configured to carry out dot-reversal driving. However, the present invention is not limited to this, but may be configured to carry out line-reversal driving.

Figure 17:
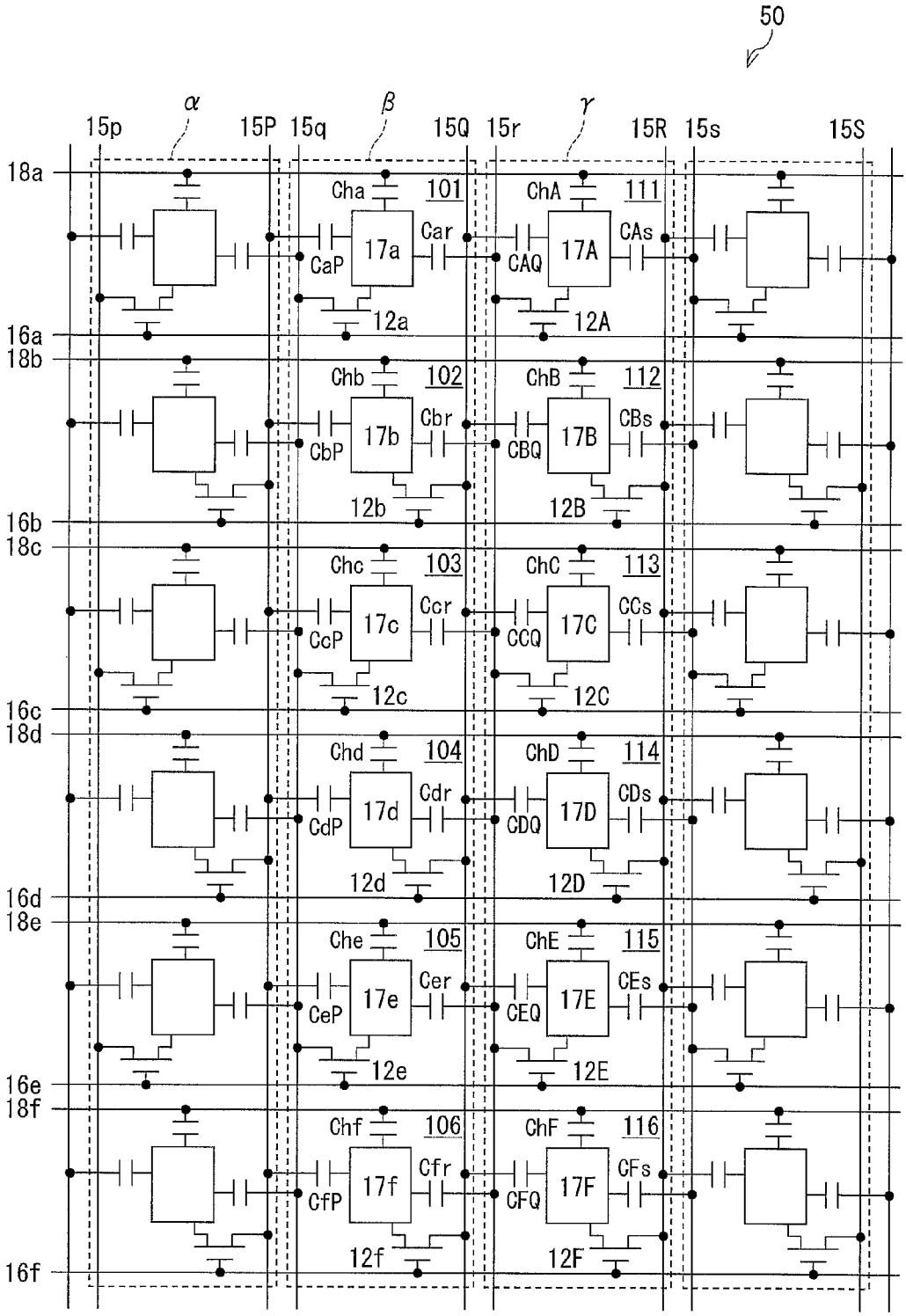
FIG. 17 is an equivalent circuit diagram showing part of a configuration of a liquid crystal panel in Example Configuration 5.
Figure 18:
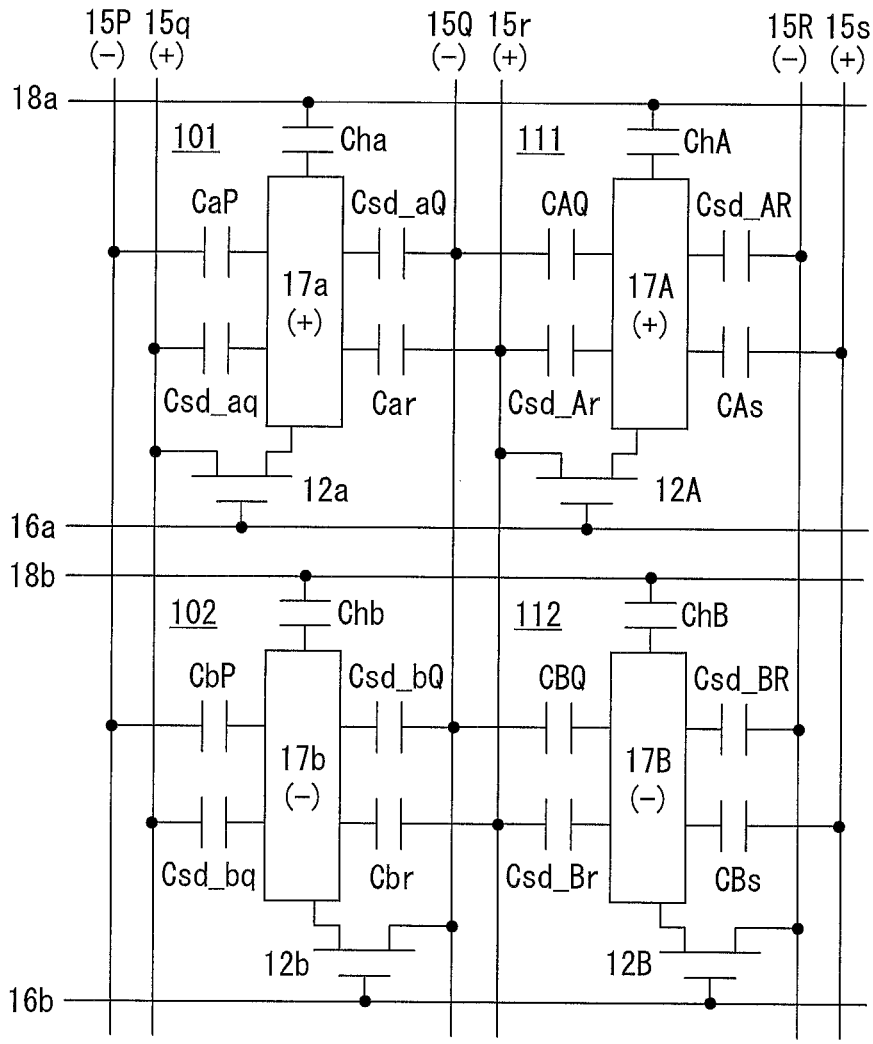
FIG. 18 is an equivalent circuit diagram showing the appearance of capacitances formed in pixels 101, 102, 111, and 112 of the liquid crystal panel of FIG. 17.

FIG. 17 is an equivalent circuit diagram showing part of a configuration of a liquid crystal panel 50 in Example Configuration 5. FIG. 18 is an equivalent circuit diagram showing the appearance of capacitances formed in pixels 101, 102, 111, and 112 of the present liquid crystal panel 50. The configuration of the present liquid crystal panel 50 is identical to that of the liquid crystal panel 10 shown in FIG. 1, and as such, is not described below.

Figure 19:
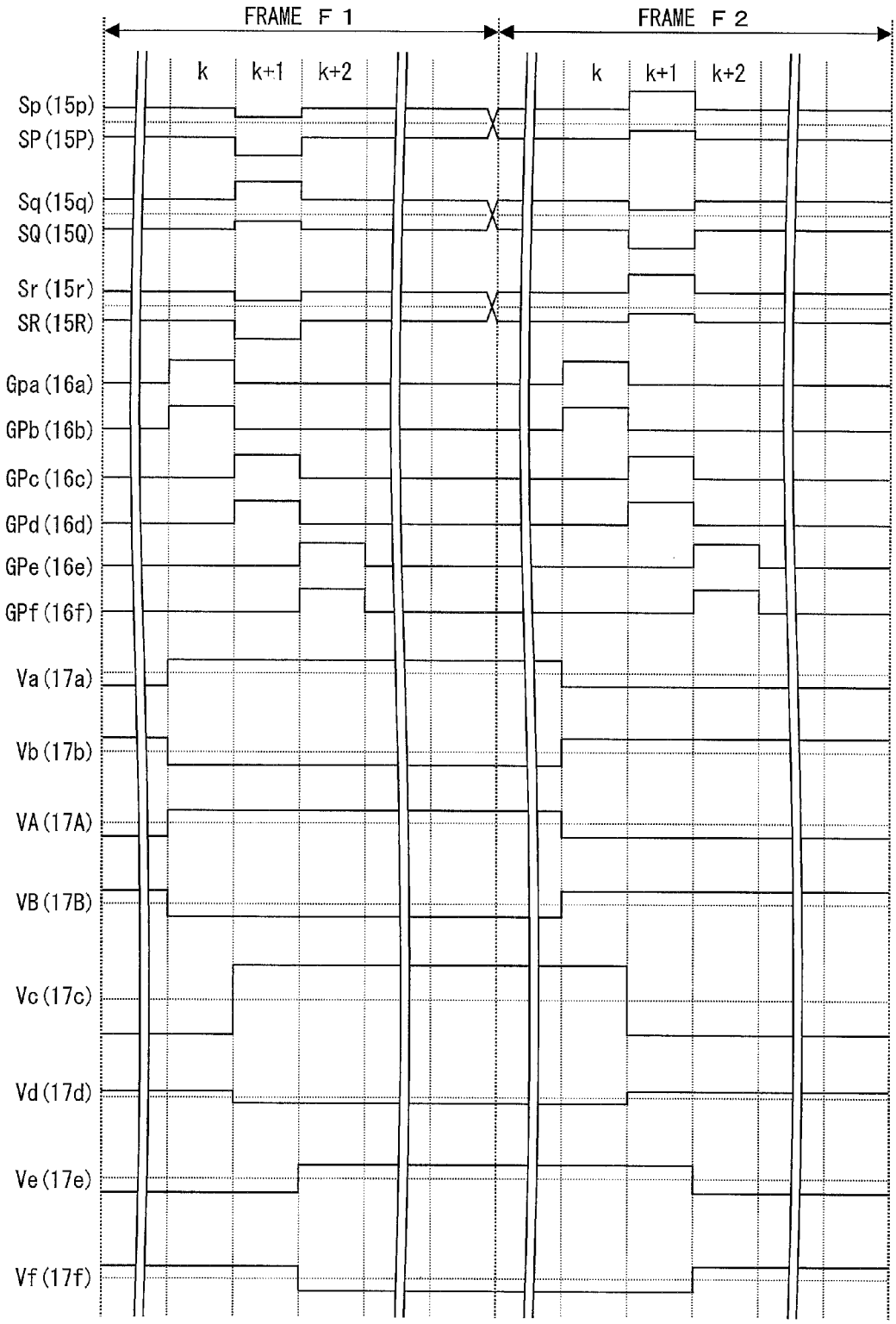
FIG. 19 is a timing chart showing a method for driving the liquid crystal panel of FIG. 17.

FIG. 19 is a timing chart showing a method (normally black mode) for driving the present liquid crystal panel 50.

Figure 20:
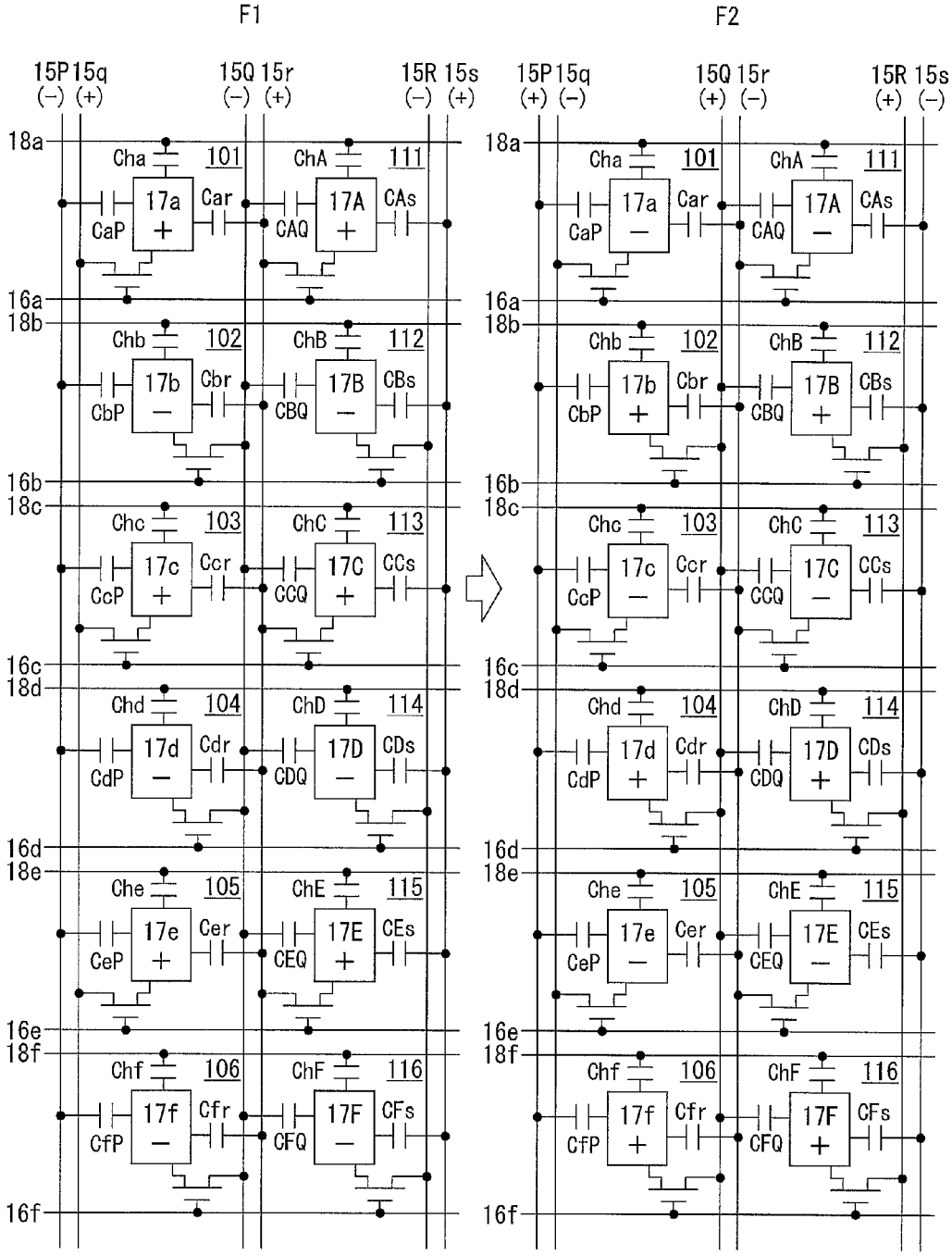
FIG. 20 is a schematic view showing a display state of the liquid crystal panel by the driving method of FIG. 19.

According to the present driving method, as shown in FIG. 19, two scanning signals are simultaneously selected at a time and each data signal line is supplied with a data signal whose polarity is reversed every single frame period, and during the same horizontal scanning period, two data signal lines (15*p* and 15P, 15*q* and 15Q, 15*r* and 15R) corresponding to the same column of pixels are supplied with data signals of opposite polarities while two adjacent data signal lines (15P and 15*q*, 15Q and 15*r*, 15R and 15*s*) are supplied with data signals of opposite polarities. Thus, as shown in FIG. 20, line-reversal driving is achieved.

Figure 21:
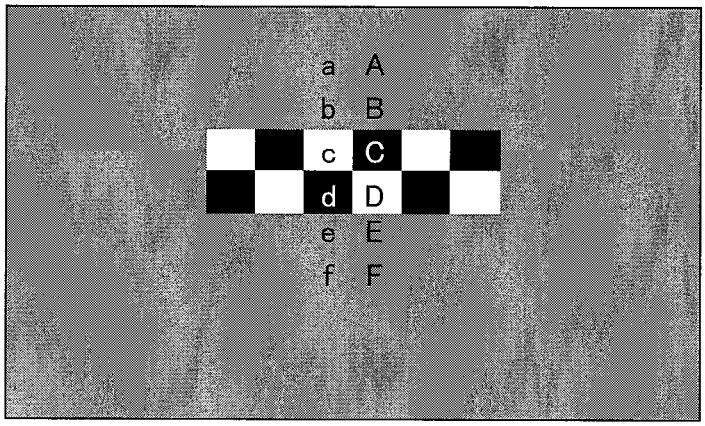
FIG. 21 is a diagram showing an example of an image that is supposed to be displayed.

Moreover, the present driving method makes it possible to suppress display unevenness that occurs when such a checkered pattern image as shown in FIG. 21 is displayed.

That is, as shown in FIG. 18, the data signal line 15*q* is supplied with a data signal of a positive polarity corresponding to gray during the kth horizontal scanning period (e.g., including the writing period for the pixel electrode 17*a*), is supplied with a data signal of a positive polarity corresponding to white during the (k+1)th horizontal scanning period (e.g., including the writing period for the pixel electrode 17*c*), and is supplied with a data signal of a positive polarity corresponding to gray during the (k+2)th horizontal scanning period (e.g., including the writing period for the pixel electrode 17*e*). Meanwhile, the data signal line 15Q is supplied with a data signal of a negative polarity corresponding to gray during the kth horizontal scanning period (e.g., including the writing period for the pixel electrode 17*b*), is supplied with a data signal of a negative polarity corresponding to black during the (k+1)th horizontal scanning period (e.g., including the writing period for the pixel electrode 17*d*), and is supplied with a data signal of a negative polarity corresponding to gray during the (k+2)th horizontal scanning period (e.g., including the writing period for the pixel electrode 17*f*). That is, at the transition from the kth horizontal scanning period to the (k+1) th horizontal scanning period, the potentials of the data signals that are supplied to the data signal lines 15*q* and 15Q change in a rising direction (positive direction), and at the transition from the (k+1)th horizontal scanning period to the (k+2)th horizontal scanning period, the potentials of the data signals that are supplied to the data signal lines 15*q* and 15Q change in a falling direction (negative direction).

For this reason, in the pixel electrode 17*a*, for example, the pixel potential Va (data signal of a positive polarity corresponding to gray) written during the kth horizontal scanning period changes in a rising direction (positive direction) in the (k+1)th horizontal scanning period due to the parasitic capacitances Csd_aq and Csd_aQ between the pixel electrode 17*a* and the data signal lines 15*q* and 15Q, respectively, and changes in a falling direction (negative direction) in the (k+2) th horizontal scanning period due to the parasitic capacitances Csd_aq and Csd_aQ between the pixel electrode 17*a* and the data signal lines 15*q* and 15Q, respectively. This causes display unevenness to occur.

In the present configuration, however, the pixel electrode 17*a* forms capacitances CaP and Car with the data signal lines 15P and 15*r*, respectively. The data signal line 15P is supplied with a data signal of a negative polarity corresponding to gray during the kth horizontal scanning period, is supplied with a data signal of a negative polarity corresponding to white during the (k+1)th horizontal scanning period, and is supplied with a data signal of a negative polarity corresponding to gray during the (k+2)th horizontal scanning period. The data signal line 15*r* is supplied with a data signal of a positive polarity corresponding to gray during the kth horizontal scanning period, is supplied with a data signal of a positive polarity corresponding to black during the (k+1)th horizontal scanning period, and is supplied with a data signal of a positive polarity corresponding to gray during the (k+2)th horizontal scanning period.

For this reason, in the pixel electrode 17*a*, the pixel potential Va (data signal of a positive polarity corresponding to gray) written during the kth horizontal scanning period changes in a falling direction (negative direction) in the (k+1) th horizontal scanning period due to the capacitances CaP and Car, respectively, and changes in a rising direction (positive direction) in the (k+2)th horizontal scanning period due to the capacitances CaP and Car. Thus, the changes in potential due to the parasitic capacitances can be canceled by the changes in potential due to the capacitances formed between the pixel electrode and the data signal lines corresponding to both adjacent columns of pixels, respectively. This makes it possible to curb the influence of a crosstalk and thus enhance display quality.

Similarly, in the pixel electrode 17*b*, the pixel potential Vb (data signal of a negative polarity corresponding to gray) written during the kth horizontal scanning period changes in a rising direction (positive direction) due to the parasitic capacitances Csd_bq and Csd_bQ between the pixel electrode 17*b* and the data signal lines 15*q* and 15Q, respectively, but changes in a falling direction (negative direction) due to the capacitances CbP and Cbr in the (k+1)th horizontal scanning period, and changes in a falling direction (positive direction) due to the parasitic capacitances Csd_bq and Csd_bQ between the pixel electrode 17*b* and the data signal lines 15*q* and 15Q, respectively, but changes in a falling direction (negative direction) due to the capacitances CbP and Cbr in the (k+2)th horizontal scanning period. Thus, the changes in potential due to the parasitic capacitances can be canceled by the changes in potential due to the capacitances formed between the pixel electrode and the data signal lines corresponding to both adjacent columns of pixels, respectively. This makes it possible to curb the influence of a crosstalk and thus enhance display quality.

Thus, even a configuration in which line-reversal driving is carried out makes it possible to suppress display unevenness that occurs in the column-wise direction.

By interchanging the polarities of the data signals that are supplied to the data signal lines 115*q* and 15Q in each of the liquid crystal panels of Example Configurations 2 to 4, line-reversal driving can be achieved, and display unevenness that occurs in such a checkered pattern display image as shown in FIG. 21 can be suppressed.

(Configurations of a Liquid Crystal Display Unit and a Liquid Crystal Display Apparatus)

Figure 22:
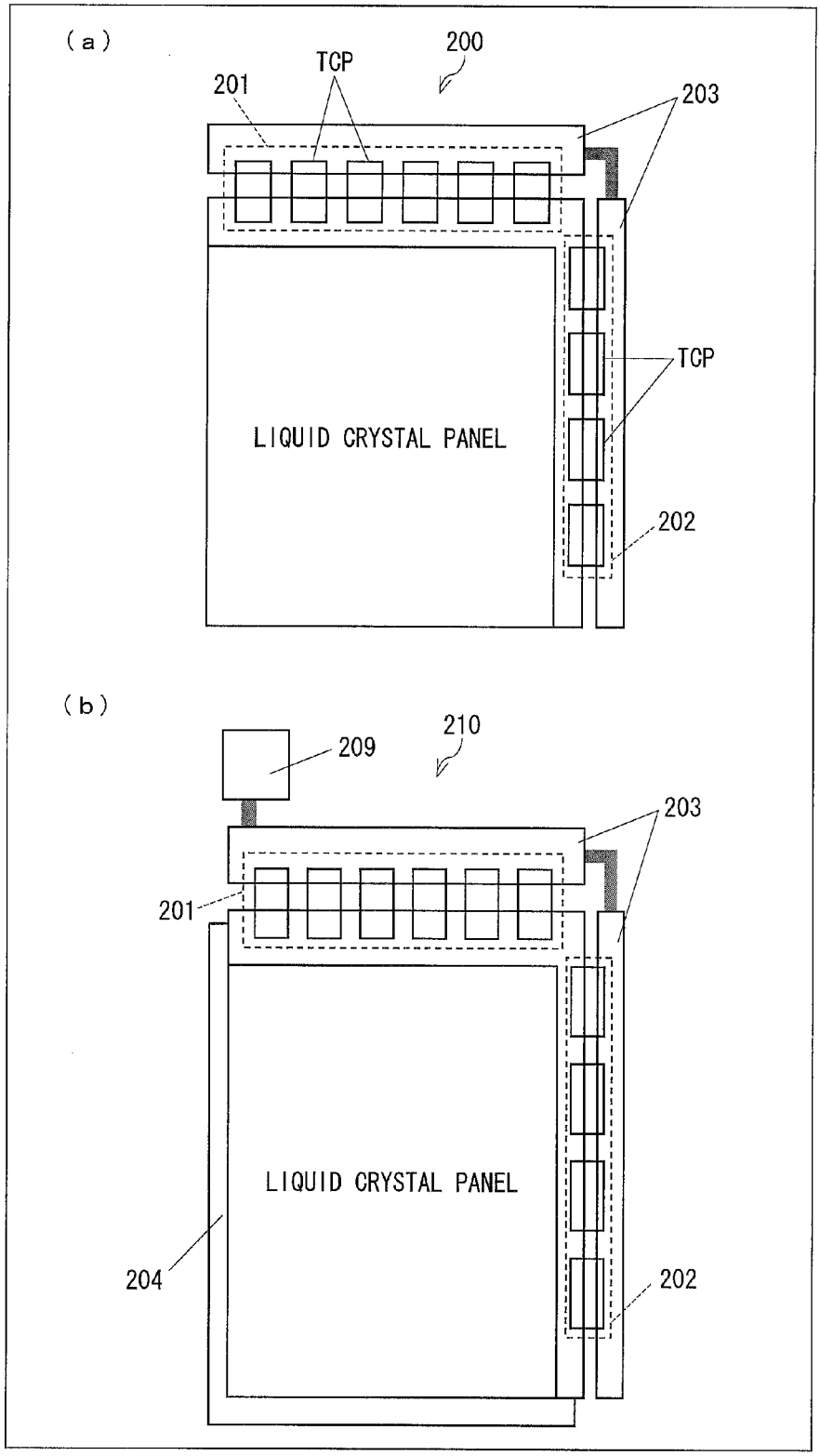
FIG. 22 is a set of schematic views (a) and (b) showing a configuration of the present liquid crystal display unit and a configuration of the present liquid crystal display apparatus, respectively.

Finally, example configurations of a liquid crystal display unit and a liquid crystal display apparatus of the present invention are described. In each of the example configurations, the present liquid crystal display unit and the present liquid crystal display apparatus are configured in the following manner. That is, two polarizers A and B are attached to both sides of the liquid crystal panel, respectively, so that the polarizers A and B have their axes of polarization orthogonal to each other. Each of the polarizers may have an optical compensator or the like joined on top thereof. Next, as shown in (a) of FIG. 22, drivers (gate driver 202, source driver 201) are connected. An example is described here where the drivers are connected by a TCP (tape carrier package) method. First, an ACF (anisotropic conductive film) is temporarily pressured-bonded to the terminal parts of the liquid crystal panel. Next, the TCPs on which the drivers have been placed are punched out from the carrier tape, aligned with the panel terminal electrodes, heated, and then permanently pressure-bonded. After that, circuit substrates 203 (PWB: printed wiring board) for coupling the driver TCPs to each other and the input terminals of the TCPs are connected via the ACF, whereby a liquid crystal display unit 200 is completed. After that, as shown in (b) of FIG. 22, a display control circuit 209 is conned to each driver (201, 202) of the liquid crystal display unit 200 via the circuit substrates 203, and the liquid crystal display unit 200 is integrated with an illumination device (backlight unit) 204, whereby a liquid crystal display apparatus 210 is obtained.

Figure 23:
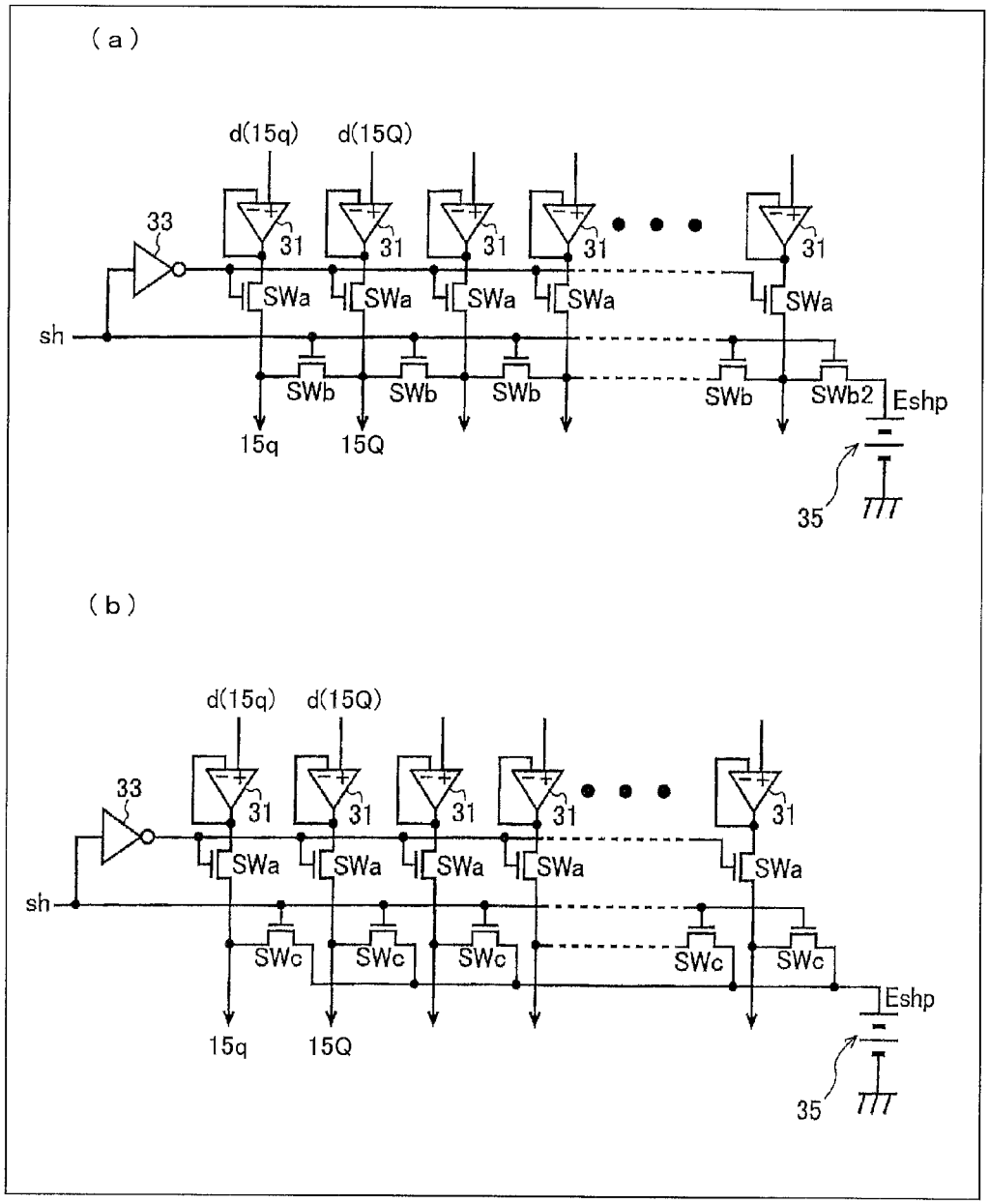
FIG. 23 is a circuit diagram showing another configuration of a source driver.

(a) of FIG. 23 shows, in the present liquid crystal display apparatus, a configuration of a source driver in a case where a refresh period is provided. For convenience, the latch circuits and the DAC circuits (digital-analog circuits) are omitted. As shown in (a) of FIG. 23, the source driver in this case is provided with buffers 31 corresponding to each separate data signal line, data output switches SWa, and refresh switches SWb. Each of the buffers 31 is supplied with corresponding data d, and has its output connected via the data output switch SWa to an output terminal to the data signal line. Further, two adjacent data signal lines have their respective output terminals connected to each other via a refresh switch Swb. That is, the refresh switches SWb are connected in series with each other and each have an end connected to a refresh potential supply source 35 (Vcom). It should be noted here that each of the data output switches SWa has its gate terminal supplied with a charge share signal sh via an inverter 33, and that each of the refresh switches SWb has its gate terminal supplied with the charge share signal sh.

The source driver shown in (a) of FIG. 23 may be configured as shown in (b) of FIG. 23. That is, the source driver shown in (a) of FIG. 23 may be configured such that refresh switches SWc are connected only to each separate data signal line and the refresh potential supply source 35 (Vcom) and that the refresh switches SWc are not connected in series. This makes it possible to quickly supply refresh potentials to each separate data signal line.

Figure 24:
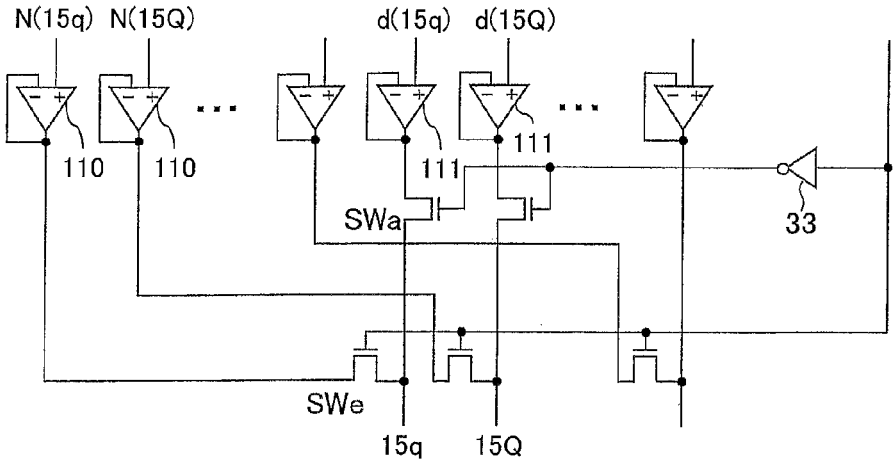
FIG. 24 is a circuit diagram showing still another configuration of a source driver.

Although the configuration of the source driver described above uses Vcom as a refresh potential, this does not imply any limitation. For example, it is possible to calculate in advance an appropriate refresh potential in accordance with the level of a signal potential supplied to a data signal line during the immediately preceding horizontal scanning period and a signal potential to be supplied to the same data signal line during the current horizontal scanning line, and to supply the refresh potential to the data signal line. A configuration of the source driver in this case is shown in FIG. 24. the source driver thus configured is provided with data output buffers 110 corresponding to each separate data signal line, refresh buffers 111 corresponding to each separate data signal line, data output switches SWa, refresh switches SWe. Each of the data output buffers 110 is supplied with corresponding data d, and has its output connected via the data output switch SWa to an output terminal to the data signal line. Each of the refresh buffers 111 is supplied with corresponding nonvisual data N (data corresponding to an optimal refresh potential determined in accordance with the level of a signal potential supplied to a data signal line during the immediately preceding horizontal scanning period and a signal potential to be supplied to the same data signal line during the current horizontal scanning line), and has its output connected via the data output switch SWe to an output terminal to the data signal line.

The term "polarity of a potential" as used in the present application means whether the potential is high (positive) or low (negative) with respect to a reference potential. The reference potential here may be Vcom (common potential), which is the potential of the common electrode (counter electrode), or may be any other potential.

Figure 25:
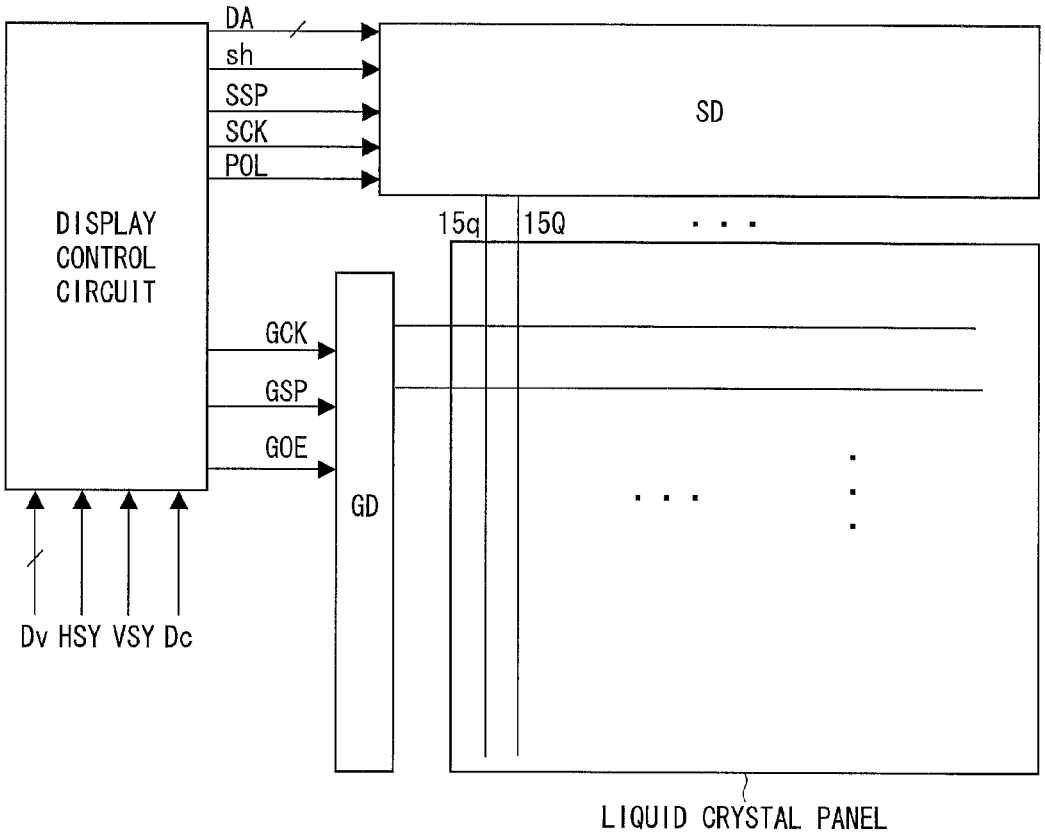
FIG. 25 is a block diagram explaining an overall configuration of the present liquid crystal display apparatus.

FIG. 25 is a block diagram showing a configuration of the present liquid crystal display apparatus. As shown in FIG. 25, the present liquid crystal display apparatus includes a display section (liquid crystal panel), a source driver (SD), a gate driver (GD), and a display control circuit. The source driver drives the data signal lines. The gate driver drives the scanning signal lines. The display control circuit controls the source driver and the gate driver.

The display control circuit receives a digital video signal Dv, a horizontal synchronizing signal HSY, a vertical synchronizing signal VSY, and a control signal Dc from an external signal source (e.g., a tuner). The digital video signal Dv represents an image to be displayed. The horizontal synchronizing signal HSY and the vertical synchronizing signal VSY correspond to the digital video signal Dv. The control signal Dc serves to control a display operation. Further, the display control circuit generates a data start pulse signal SSP, a data clock signal SCK, a charge share signal sh, a digital image signal DA (which is a signal corresponding to the video signal Dv), a gate start pulse signal GSP, a gate clock signal GCK, and a gate driver output control signal (scanning signal output control signal) GOE in accordance with the signals Dv, HSY, VSY, and Dc thus received, and then outputs the signals SSP, SCK, sh, DA, GSP, GCK, and GOE. The signals SSP, SCK, sh, DA, GSP, GCK, and GOE serve as signals for causing the display section to display the image represented by the digital video signal Dv. The digital image signal DA represents the image to be displayed.

More specifically, after adjusting the timing and the like of the video signal Dv as needed in an internal memory, the display control circuit outputs the video signal Dv as the digital image signal DA, generates the data clock signal SCK as a signal composed of pulses corresponding to each separate pixel of the image represented by the digital image signal DA, generates the data start pulse signal SSP in accordance with the horizontal synchronizing signal HSY as a signal that is at a high level (H level) for a predetermined period of time every single horizontal scanning period, generates the gate start pulse signal GSP in accordance with the vertical synchronizing signal VSY as a signal that is at a H level for a predetermined period of time every single frame period (single vertical scanning period), generates the gate clock signal GCK in accordance with the horizontal synchronizing signal HSY, and generates the charge share signal sh and the gate driver output control signal GOE in accordance with the horizontal synchronizing signal HSY and the control signal Dc.

Of the signals thus generated by the display control circuit, the digital image signal DA, the charge share signal sh, a signal POL for controlling the polarity of a signal potential (data signal potential), the data start pulse signal SSP, and the data clock signal SCK are inputted to the source driver, and the gate start pulse signal GSP, the gate clock signal GCK, and the gate driver output control signal GEO are inputted to the gate driver.

In accordance with the digital image signal DA, the data clock signal SCK, the charge share signal sh, the data start pulse signal SSP, and the polarity reversal signal POL, the source driver generates analog potentials (signal potentials) in sequence every single horizontal scanning period, the analog potentials being equivalent to the values of pixels in each scanning signal line of the image represented by the digital image signal DA, and then outputs these data signals to data signal lines (e.g., 15*q* and 15Q).

The gate driver generates a gate on pulse signal in accordance with the gate start pulse signal GSP, the gate clock signal GCK, and the gate driver output control signal GOE and outputs these signals to the scanning signal lines, thereby selectively driving the scanning signal lines.

By the source driver and the gate driver thus driving the data signal lines and the scanning signal lines of the display section (liquid crystal panel), a signal potential is written to each pixel electrode through a data signal line via a transistor (TFT) connected to the scanning signal line selected. This causes a voltage to be applied to the liquid crystal layer of each subpixel, whereby the amount of transmission of light from the backlight is controlled and the image represented by the digital video signal Dv is displayed in each subpixel.

Figure 26:
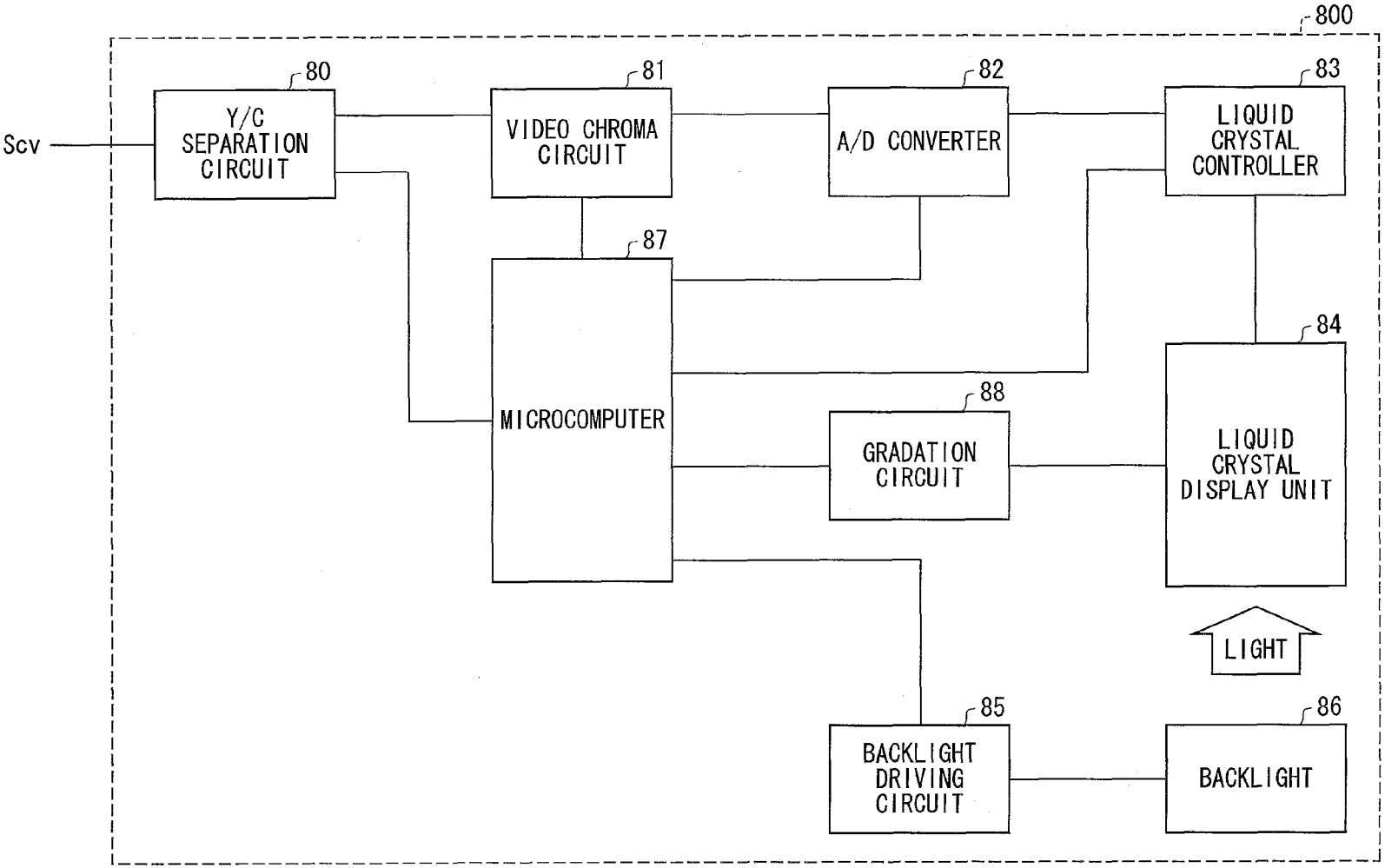
FIG. 26 is a block diagram explaining a function of the present liquid crystal display apparatus.

Next, an example configuration is described in which the present is applied to a television receiver. FIG. 26 is a block diagram showing a configuration of a liquid crystal display apparatus 800 for use in a television receiver. The liquid crystal display apparatus 800 includes a liquid crystal display unit 84, a Y/C separation circuit 80, a video chroma circuit 81, an A/D converter 82, a liquid crystal controller 83, a backlight driving circuit 85, a backlight 86, a microcomputer 87, and a gradation circuit 88. It should be noted that the liquid crystal display unit 84 is constituted by a liquid crystal panel and source and gate drivers for driving the liquid crystal panel.

In the liquid crystal display apparatus 800 thus configured, the Y/C separation circuit 80 receives a composite color picture signal Scv serving as a television signal from an outside source, separates the composite color picture signal Scv into a luminance signal and a color signal, and sends the luminance signal and the color signal to the video chroma circuit 81. The video chroma circuit 81 converts the luminance signal and the color signal into an analog RGB signal corresponding to three primary colors of light, and sends the analog RGB signal to the A/D converter 82. The A/D converter 82 converts the analog RGB signal into a digital RGB signal, and sends the digital RGB signal to the liquid crystal controller 83. Meanwhile, the Y/C separation circuit 80 extracts horizontal and vertical synchronizing signals from the composite color picture signal Scv sent from the outside source, and sends these synchronizing signals to the liquid crystal controller 83 via the microcomputer 87.

The liquid crystal display unit 84 receives the digital RGB signal from the liquid crystal controller 83 at a predetermined timing together with a timing signal based on the synchronizing signals. Further, the gradation circuit 88 generates the respective gradation potentials of the three primary colors R, G, and B of a color display, and supplies these gradation potentials to the liquid crystal display unit 84. The liquid crystal display unit 84 uses its internal source and gate drivers and the like to generate driving signals (data signals=signal potentials, scanning signals, etc.) in accordance with the RGB signal, the timing signal, and the gradation potentials, and uses its internal liquid crystal panel to display a color image in accordance with the driving signals. In order for an image to be displayed by the liquid crystal display unit 84, it is necessary to irradiate the back of the liquid crystal panel provided in the liquid crystal display unit with light. In this liquid crystal display apparatus 800, the back surface of the liquid crystal panel is irradiated with light by the backlight driving circuit 85 driving the backlight 86 under control of the microcomputer 87. Overall control of the system, including the above process, is carried out by the microcomputer 87. As a picture signal (composite color picture signal) that is sent from an outside source, a picture signal that is taken by a camera, a picture signal that is supplied via an Internet line, or the like, as well as a picture signal based on a television broadcast, can be used. The liquid crystal display apparatus 800 is capable of displaying images based on various picture signals.

Figure 27:
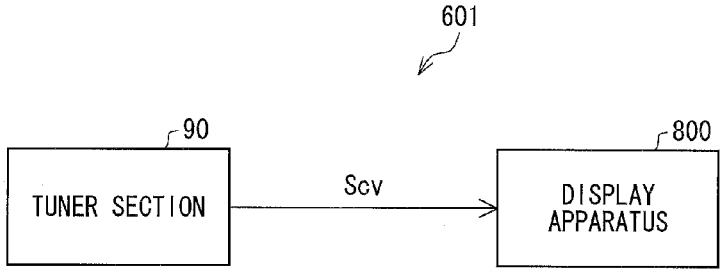
FIG. 27 is a block diagram explaining a function of the present television receiver.

In a case where the liquid crystal display apparatus 800 displays an image based on a television broadcast, a tuner section 90 is connected to the liquid crystal display apparatus 800 as shown in FIG. 27, whereby the present television receiver 601 is configured. The tuner section 90 extracts, from among received waves (high-frequency signals) received by an antenna (not illustrated), a signal of the channel to be received, converts the signal into an intermediate frequency signal, and detects the intermediate frequency signal, thereby extracting a composite color picture signal Scv as a television signal. The tuner section 90 sends the composite color picture signal Scv to the liquid crystal display apparatus 800 as already explained, and the liquid crystal display apparatus 800 displays an image based on the composite color picture signal Scv.

It should be noted that the present liquid crystal display apparatus can also be applied to a digital television. The present digital television is schematically configured to include a speaker, a digital broadcasting antenna, a digital tuner, a digital demodulation section, a separation section (DMUX), a video decode/capture section, a picture processing section, a display control section, an audio decode section, an sound output control section, a select section, an EPG/OSD reservation processing section, a remote controller light-receiving section, a communication control section, a nonvolatile memory, an IP broadcasting tuner, and a CPU. A well-known configuration can be applied to each component of the present digital television except for the components of the present liquid crystal display apparatus.

Figure 28:
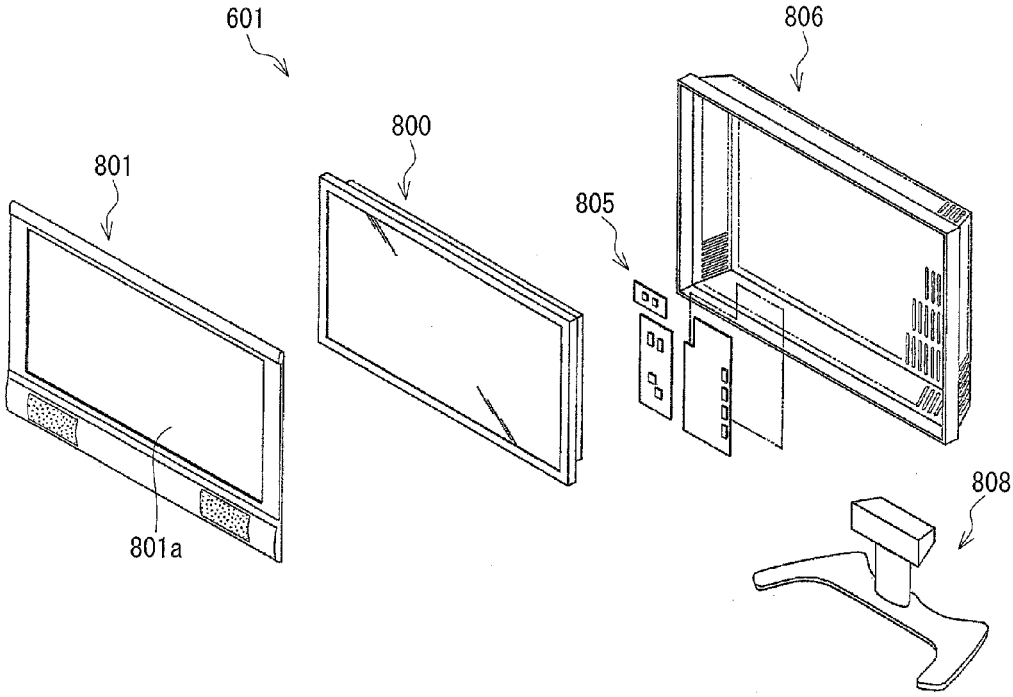
FIG. 28 is an exploded perspective view showing a configuration of the present television receiver.
Figure 29:
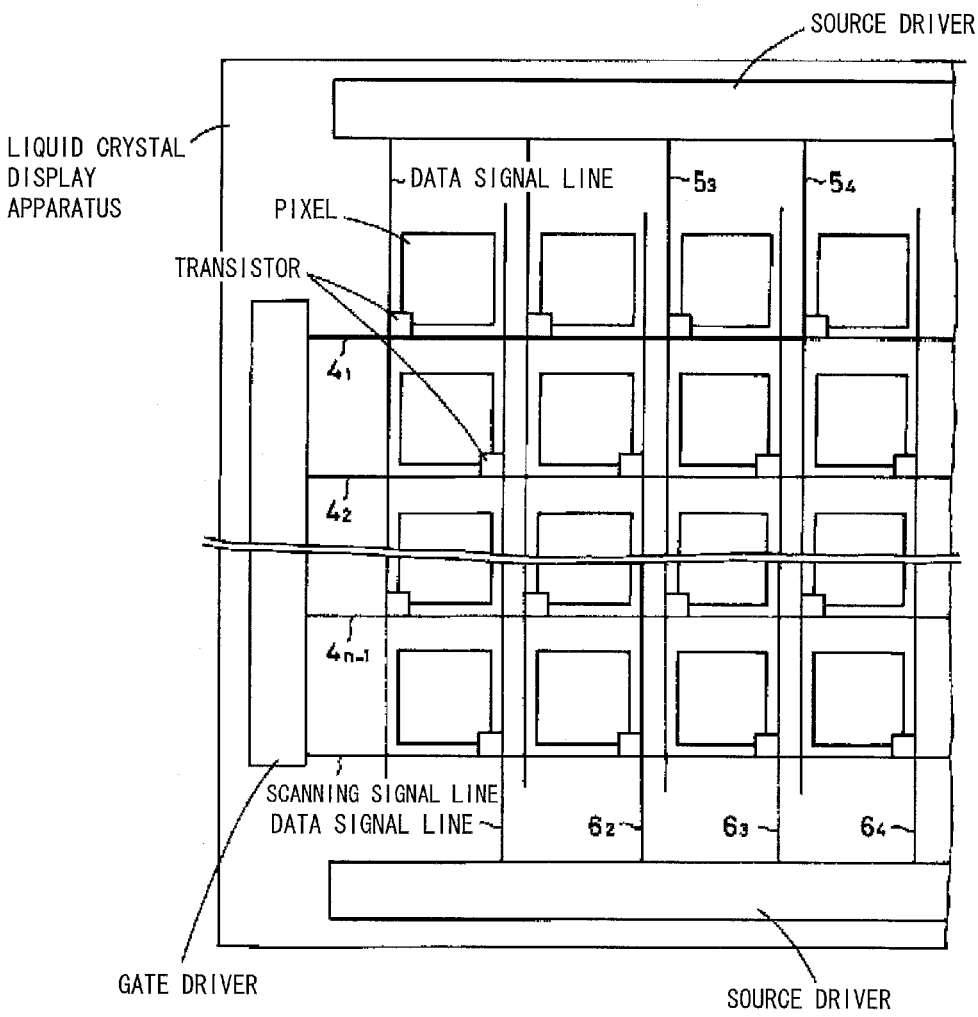
FIG. 29 PRIOR ART
FIG. 29 is a plan view showing a configuration of a conventional liquid crystal display apparatus.
Figure 30:
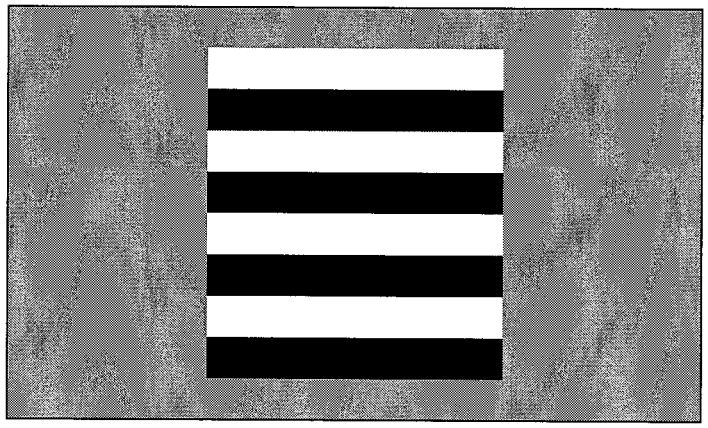
FIG. 30 is a diagram showing an example of an image that is supposed to be displayed.

FIG. 28 is an exploded perspective view showing an example configuration of the present television receiver. As shown in FIG. 28, the present television receiver 601 has as its components a first housing 801 and a second housing 806 in addition to the liquid crystal display apparatus 800, and is configured such that the liquid crystal display apparatus 800 is sandwiched between the first housing 801 and the second housing 806 in an encompassing manner. The first housing 801 is provided with an opening 801*a* through which an image displayed on the liquid crystal display apparatus 800 is transmitted. Meanwhile, the second housing 802 covers the back of the liquid crystal display apparatus 800, and is provided with an operation circuit 805 for operating the liquid crystal display apparatus 800. Attached to the lower side of the second housing 12 is a supporting member 808.

As described above, a display device according to the present invention is a display device including: a plurality of scanning signal lines; and a plurality of data signal lines, two of which are provided for each column of pixels containing a plurality of pixels arranged in a column-wise direction in which the data signal lines extend, in each column of pixels, a pixel electrode contained in either of two pixels adjacent to each other in the column-wise direction and a pixel electrode contained in the other one of the two pixels adjacent to each other being connected to different data signal lines via transistors, respectively, for a first, a second, and a third columns of pixels arranged in sequence, each pixel electrode contained in the second column of pixels forming a capacitance with either of the two data signal lines provided for the first column of pixels and forming a capacitance with either of the two data signal lines provided for the third column of pixels.

According to the foregoing configuration, the influence of a crosstalk due to parasitic capacitances formed between each pixel electrode and data signal lines corresponding to the pixel, respectively, can be curbed by capacitances formed between that pixel electrode and data signal lines corresponding to both adjacent columns of pixels, respectively. This makes it possible to suppress a change in pixel potential in each pixel electrode and thus enhance the display quality of the liquid crystal display apparatus.

The display device can also be configured such that for the first, the second, and the third columns of pixels arranged in sequence, each pixel electrode contained in the first column of pixels forms a capacitance with either of the two data signal lines provided for the second column of pixels, and each pixel electrode contained in the third column of pixels forms a capacitance with the other one of the two data signal lines provided for the second column of pixels.

The display device can also be configured such that each pixel electrode contained in the second column of pixels is placed in such a way as to overlap either of the two data signal lines provided for the first column of pixels and is placed in such a way as to overlap either of the two data signal lines provided for the third column of pixels.

The display device can also be configured such that: each pixel electrode contained in the first column of pixels is placed in such a way as to overlap either of the two data signal lines provided for the second column of pixels; and each pixel electrode contained in the third column of pixels is placed in such a way as to overlap the other one of the two data signal lines provided for the second column of pixels.

The display device can also be configured such that: N (where N is an integer of 1 or greater) of the scanning signal lines is/are simultaneously selected at a time; and a pixel electrode contained in either of two pixels adjacent to each other in the column-wise direction and a pixel electrode contained in the other one of the two pixels adjacent to each other are connected to transistors, respectively, each of which is connected to N scanning signal lines that are simultaneously selected.

The display device can also be configured such that: N is 2 so that two of the scanning signal lines are simultaneously selected at a time; and the pixel electrode contained in either of the two pixels adjacent to each other is connected to a transistor connected to either of two scanning signal lines that are simultaneously selected, and the pixel electrode contained in the other one of the two pixels adjacent to each other is connected to a transistor connected to the other one of the two scanning signal lines that are simultaneously selected.

The display device can also be configured such that during an identical horizontal scanning period, the two data signal lines provided for each column of pixels are supplied with data signals that are different in polarity from each other.

The display device can also be configured such that each pixel is provided with a plurality of pixel electrode.

To the display device, dot-reversal driving or line-reversal driving can be applied.

A liquid crystal display apparatus includes such a display device. A television receiver includes: such a liquid crystal display apparatus; and a tuner section which receives a television broadcast.

The present invention is not limited to the description of the embodiments above. An embodiment based on a proper alteration of the embodiment or on a proper combination of the embodiments is encompassed in the embodiments of the present invention.

INDUSTRIAL APPLICABILITY

A liquid crystal panel of the present invention is suitable, for example, to a liquid crystal television.

REFERENCE SIGNS LIST

10, 20, 30, 40, 50 Liquid crystal panel
101 to 106, 111 to 116 Pixel
a to f, A to F Pixel
12*a* to 12*f*, 12A to 12F Transistor
15*p*, 15P, 15*q*, 15Q, 15*r*, 15R, 15*s*, 15S Data signal line
16*a* to 16*f*, 16*ab*, 16*cd*, 16*ef* Scanning signal line
17*a* to 17*f*, 17A to 17F Pixel electrode
18*a* to 18*f*, 18*g*, 18*h*, 18*i* Retention capacitor wire
α Column of pixels (first column of pixels)
β Column of pixels (second column of pixels)
γ Column of pixels (third column of pixels)
84 Liquid crystal display unit
601 Television receiver
800 Liquid crystal display apparatus (display device)

The invention claimed is:

1. A display device comprising:

a plurality of scanning signal lines; and a plurality of data signal lines, two of which are provided for each column of pixels containing a plurality of pixels arranged in a column-wise direction in which the data signal lines extend, a first data signal line of the two data signal lines being provided on a left side of each of the columns of the pixels, and a second data signal line of the two data signal lines being provided on a right side of each of the columns of the pixels, wherein in each of the columns of the pixels, a pixel electrode contained in one of two pixels adjacent to each other in the column-wise direction is connected to the first data signal line via a transistor, and a pixel electrode contained in another one of the two pixels adjacent to each other in the column-wise direction is connected to the second data signal line via another transistor, for a first, a second, and a third of the columns of the pixels arranged in sequence, the second data signal line provided to the first column of the pixels is adjacent to the first data signal line provided to the second column of the pixels, and the second data signal line provided to the second column of the pixels is adjacent to the first data signal line provided to the third column of the pixels, each pixel electrode contained in the second column of pixels being configured to generate: (i) a first parasitic capacitance with the second data signal line provided to the first column of the pixels, (ii) a second parasitic capacitance with the first data signal line provided to the second column of the pixels, (iii) a third parasitic capacitance with the second data signal line provided to the second column of the pixels, and (iv) a fourth parasitic capacitance with the first data signal line provided to the third column of the pixels, and a potential of the each pixel electrode changes due to the first and fourth parasitic capacitances in a direction in which a change in potential of the each pixel electrode due to the second and third parasitic capacitances is cancelled, and wherein each pixel electrode contained in the second column of the pixels overlaps the second data signal line provided to the first column of pixels and the first data signal line provided to the second column of the pixels, and overlaps the second data signal line provided to the second column of the pixels and the first data signal line provided to the third column of the pixels.

2. The display device as set forth in claim 1, wherein:

N (where N is an integer of 1 or greater) of the scanning signal lines is/are simultaneously selected at a time; and a pixel electrode contained in either of two pixels adjacent to each other in the column-wise direction and a pixel electrode contained in another one of the two pixels adjacent to each other are connected to transistors, respectively, each of which is connected to N scanning signal lines that are simultaneously selected.

3. The display device as set forth in claim 2, wherein:

N is 2 so that two of the scanning signal lines are simultaneously selected at a time; and the pixel electrode contained in either of the two pixels adjacent to each other is connected to a transistor connected to either of two scanning signal lines that are simultaneously selected, and the pixel electrode contained in the another one of the two pixels adjacent to each other is connected to a transistor connected to the other one of the two scanning signal lines that are simultaneously selected.

4. The display device as set forth in claim 1, wherein during an identical horizontal scanning period, the two data signal lines provided for each column of the pixels are supplied with data signals that are different in polarity from each other.

5. The display device as set forth in claim 1, wherein each of the pixels is provided with a plurality of pixel electrodes.

6. The display device as set forth in claim 1, wherein a method for driving the display device is dot-reversal driving or line-reversal driving.

7. A liquid crystal display apparatus comprising a display device as set forth in claim 1.

8. A television receiver comprising:

a liquid crystal display apparatus as set forth in claim 7; and a tuner section which receives a television broadcast.

* * * * *